US010854373B2

(12) United States Patent
Nakanishi et al.

(10) Patent No.: US 10,854,373 B2
(45) Date of Patent: Dec. 1, 2020

(54) INDUCTOR DEVICE

(71) Applicant: SHINKO ELECTRIC INDUSTRIES CO., LTD., Nagano (JP)

(72) Inventors: Tsukasa Nakanishi, Nagano (JP); Kiyokazu Sato, Nagano (JP); Osamu Hoshino, Nagano (JP)

(73) Assignee: SHINKO ELECTRIC INDUSTRIES CO., LTD., Nagano (JP)

( * ) Notice: Subject to any disclaimer, the term of this patent is extended or adjusted under 35 U.S.C. 154(b) by 333 days.

(21) Appl. No.: 15/880,003

(22) Filed: Jan. 25, 2018

(65) Prior Publication Data

US 2018/0218830 A1 Aug. 2, 2018

(30) Foreign Application Priority Data

Feb. 1, 2017 (JP) ..... 2017-016469

(51) Int. Cl.
*H01F 27/32* (2006.01)
*H01F 27/28* (2006.01)
(Continued)

(52) U.S. Cl.
CPC ..... *H01F 27/2852* (2013.01); *H01F 17/0013* (2013.01); *H01F 27/2804* (2013.01);
(Continued)

(58) Field of Classification Search
CPC ..... H01F 27/2852; H01F 41/046; H01F 17/0013; H01F 27/29; H01F 27/2828;
(Continued)

(56) References Cited

U.S. PATENT DOCUMENTS 9,236,171 B2 * 1/2016 Ito ..... H01F 17/04
9,976,224 B2 * 5/2018 Jeong ..... C25D 7/001
(Continued)

FOREIGN PATENT DOCUMENTS

JP H11-016729 A 1/1999
JP 2001-094252 A 4/2001
(Continued)

OTHER PUBLICATIONS

Japanese Office Action with English Translation dated Jun. 30, 2020, 12 pages.

*Primary Examiner* — Tuyen T Nguyen
(74) *Attorney, Agent, or Firm* — Rankin, Hill & Clark LLP

(57) ABSTRACT

An inductor device includes a resin film, a first base conductor layer formed on one surface of the resin film and having a first pad, a second base conductor layer formed on the other surface of the resin film and having a second pad, a through-hole penetrating from the first pad to the second pad, a through conductor filled in the through-hole and provided to connect the first pad and the second pad each other, a first insulating layer formed on the one surface of the resin film and having an opening arranged on the first base conductor layer, and a first conductor part formed on the first base conductor layer in the opening of the first insulating layer. A first conductor pattern layer includes the first base conductor layer and the first conductor part. The first conductor pattern layer has a convex sectional shape.

19 Claims, 15 Drawing Sheets

(51) Int. Cl.
*H01F 41/04* (2006.01)
*H01F 17/00* (2006.01)
*H01F 27/29* (2006.01)

(52) U.S. Cl.
CPC ..... *H01F 27/2828* (2013.01); *H01F 27/29* (2013.01); *H01F 27/32* (2013.01); *H01F 41/046* (2013.01); *H01F 2027/2809* (2013.01)

(58) Field of Classification Search
CPC ..... H01F 27/2804; H01F 27/32; H01F 2027/2809; H01F 17/0006; H01F 27/28; H01F 27/323; H01F 41/042; H01F 41/122
See application file for complete search history.

(56) References Cited

U.S. PATENT DOCUMENTS

| | | | | |
|---|---|---|---|---|
| 10,319,515 | B2 * | 6/2019 | Jung | H01F 27/292 |
| 2004/0164835 | A1 * | 8/2004 | Shoji | H01F 17/0013 336/200 |
| 2015/0035634 | A1 | 2/2015 | Nakamura et al. | |
| 2015/0048920 | A1 | 2/2015 | Lee et al. | |

FOREIGN PATENT DOCUMENTS

| | | |
|---|---|---|
| JP | 2005-210010 | 8/2005 |
| JP | 2012-182740 A | 9/2012 |
| JP | 2015-32625 | 2/2015 |
| JP | 2015-37179 | 2/2015 |
| JP | 2016-009862 | 1/2016 |

* cited by examiner (REDUCED PLAN VIEW)

(PARTIAL PLAN VIEW)

(PARTIALLY ENLARGED PLAN VIEW)

INDUCTOR DEVICE

CROSS-REFERENCE TO RELATED APPLICATION

The present application claims priority from Japanese Patent Application No. 2017-016469 filed on Feb. 1, 2017, the entire content of which is incorporated herein by reference.

BACKGROUND

Technical Field

The present invention relates to an inductor device.

Related Art

In the related art, an inductor device that is used for a high frequency circuit of an electronic device and the like has been known. As a structure of the inductor device, a winding type inductor device having an electric wire wound thereto, a planar type inductor device having a spiral coil conductor formed on a plane, and the like have been known.

Patent Document 1: JP-A-2005-210010

Patent Document 2: JP-A-2015-32625

Patent Document 3: JP-A-2015-37179

Patent Document 4: JP-A-2016-9862

As described later in paragraphs of preliminary matters, in a method of forming a conductor pattern layer of an inductor device, a base copper layer pattern of a thin film is formed on a substrate, and a resist layer pattern is arranged between the adjacent base copper layer patterns.

Also, a first copper-plated layer is formed on each base copper layer pattern, the resist layer is removed, and then a second plated layer is further formed on the first copper-plated layer. Thereby, the first copper-plated layer and the second copper-plated layer are formed on the base copper layer pattern, so that a conductor pattern layer having a desired cross-sectional area is obtained.

In the method of forming the conductor pattern layer, when a pitch of the base copper layer pattern is narrowed, the adjacent second copper-plated layers are likely to contact each other, so that an electric short of the conductor pattern layer is easily caused.

SUMMARY

Exemplary embodiments of the present invention provide an inductor device having a novel structure capable of reliably forming a conductor pattern layer having a desired cross-sectional area.

An inductor device according to an exemplary embodiment comprises:

a resin film;

a first base conductor layer formed on one surface of the resin film and having a first pad;

a second base conductor layer formed on the other surface of the resin film and having a second pad at a position corresponding to the first pad;

a through-hole penetrating from the first pad to the second pad via the resin film;

a through conductor filled in the through-hole and provided to connect the first pad and the second pad each other;

a first insulating layer formed on the one surface of the resin film and having an opening arranged on the first base conductor layer; and a first conductor part formed on the first base conductor layer in the opening of the first insulating layer, wherein a first conductor pattern layer includes the first base conductor layer and the first conductor part, and the first conductor pattern layer has a convex sectional shape.

A method of manufacturing an inductor device, according to an exemplary embodiment, the method comprises:

preparing a stacked base material comprising a resin film, a first metal foil adhered to one surface of the resin film and a second metal foil adhered to the other surface of the resin film;

patterning the first metal foil of the stacked base material to form a first base conductor layer having a first pad;

forming a through-hole penetrating the stacked base material from the first pad to the second metal foil;

forming a through conductor in the through-hole to connect the first pad and the second metal foil via the through conductor;

pattering the second metal foil to form a second base conductor layer having a second pad to be connected to the through conductor;

forming, on one surface of the resin film, a first insulating layer having an opening arranged on the first base conductor layer; and forming a first conductor part on the first base conductor layer in the opening of the first insulating layer by an electrolytic plating and obtaining a first conductor pattern layer including the first base conductor layer and the first conductor part, wherein the first conductor pattern layer has a convex sectional shape.

According to the present invention to be described later, the inductor device includes the first base conductor layer formed on one surface of the resin film and having the first pad and the second base conductor layer formed on the other surface and having the second pad at the position corresponding to the first pad.

The through-hole penetrating from the first pad to the second pad is formed, and the through-hole is filled with the through conductor for connecting the first pad and the second pad each other.

Also, the first insulating layer having the opening arranged on the first base conductor layer is formed on one surface of the resin film. Also, the first conductor part is formed on the first base conductor layer in the opening of the first insulating layer.

The first conductor pattern layer is formed by the first base conductor layer and the first conductor part, and the first conductor pattern layer has a convex sectional shape.

In one favorable aspect, the first base conductor layer is formed of a metal foil of a thick film. For this reason, the first conductor part is formed on the first base conductor layer in the opening of the first insulating layer, so that it is possible to obtain the first conductor pattern layer having a desired thickness.

Also, since the first insulating layer is arranged as a wall between the adjacent the first base conductor layers, when increasing a cross-sectional area of the first base conductor layer, the first conductor pattern layers are not contacted, so that an electric short is prevented.

Also, since the width of the opening of the first insulating layer is set smaller than the width of the first base conductor layer, the first conductor pattern layer formed by the first base conductor layer and the first conductor part has a convex sectional shape.

For this reason, it is possible to increase the cross-sectional area of the first base conductor layer without increasing an arrangement pitch of the first base conductor layer.

DETAILED DESCRIPTION

Hereinafter, an exemplary embodiment will be described with reference to the accompanying drawings.

Before describing the exemplary embodiment, preliminary matters that are bases of the present invention are first described.

FIGS. 1A to 2B illustrate a method of forming a conductor pattern layer of an inductor device in accordance with the preliminary matters. The descriptions of the preliminary matters relate to personal investigation contents of the inventors, and include technology contents that are not a well-known technology.

Figure 1A:
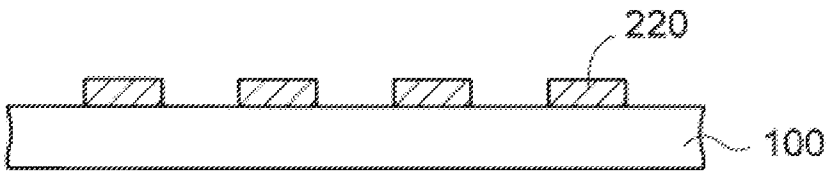
FIGS. 1A to 1C are sectional views depicting a method of forming a conductor pattern layer of an inductor device in accordance with preliminary matters (1 thereof).

In a method of forming a conductor pattern layer of an inductor device in accordance with the preliminary matters, as shown in FIG. 1A, a copper layer is first formed on a substrate 100 by plating, and the copper layer is patterned to form a base copper layer pattern 220. The base copper layer pattern 220 is formed as a thin film having a thickness of about 2 μm to 5 μm.

Figure 1B:
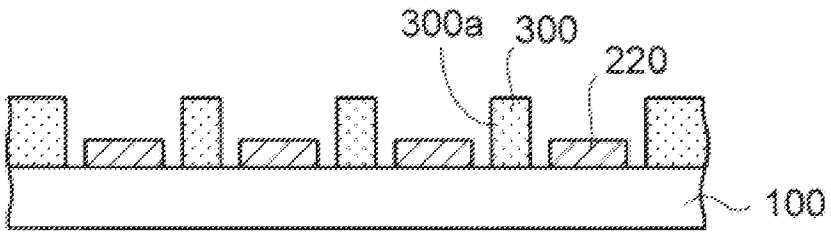

Then, as shown in FIG. 1B, a pattern of a resist layer 300 having openings 300*a* arranged on the base copper layer pattern 220 is arranged between the adjacent base copper layer patterns 220. The resist layer 300 is formed as a wall for separating each electrolytic plated layer when forming the electrolytic plated layer on each base copper layer pattern 220.

Figure 1C:
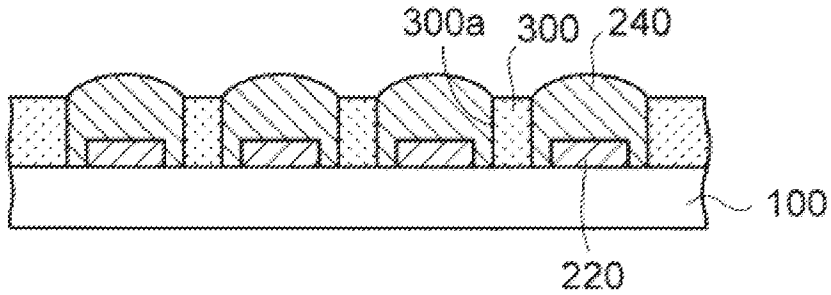
Figure 2A:
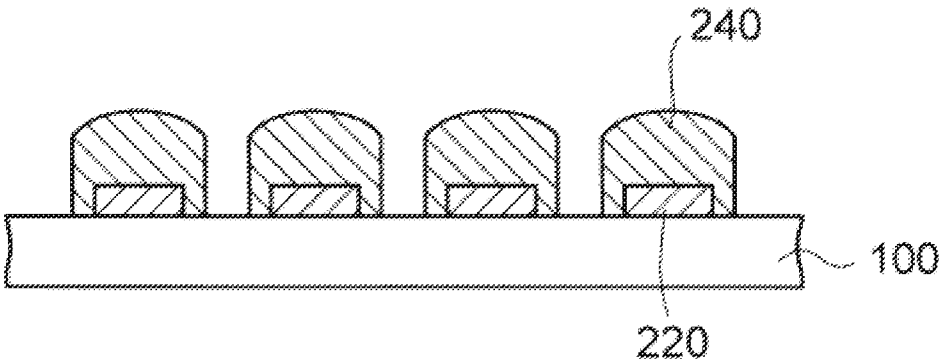
FIGS. 2A and 2B are sectional views depicting the method of forming the conductor pattern layer of the inductor device in accordance with the preliminary matters (2 thereof).

Then, as shown in FIG. 1C, a first copper-plated layer 240 is formed on the base copper layer pattern 220 by an electrolytic plating in which the base copper layer pattern 220 is used as a plating power feeding path. Thereafter, as shown in FIG. 2A, the resist layer 300 is removed.

Figure 2B:
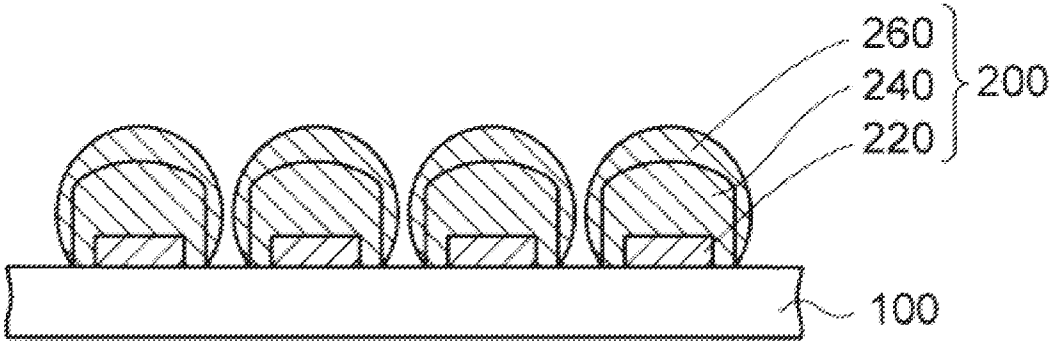

Also, as shown in FIG. 2B, a second copper-plated layer 260 is formed on the base copper layer pattern 220 and the first copper-plated layer 240 by the electrolytic plating.

In this way, the first copper-plated layer 240 and the second copper-plated layer 260 are formed on the base copper layer pattern 220 of a thin film, so that a conductor pattern layer 200 having a desired cross-sectional area is obtained.

When the cross-sectional area of the conductor pattern layer 200 is set to be large, a direct current resistance of the conductor pattern layer 200 is reduced, so that it is possible to reduce the power consumption of the inductor device.

In the formation method of the conductor pattern layer 200, the formation of the second copper-plated layer 260 in FIG. 2B is performed after the resist layer 300 is removed. For this reason, when a pitch of the base copper layer pattern 220 is narrowed, the adjacent conductor pattern layers 200 are likely to contact each other, so that an electric short is easily caused.

In recent years, the conductor pattern layer 200 is required to have a thickness of about 100 μm, for example. However, in the process of forming the pattern of the resist layer 300 of FIG. 1B by a photolithography method, the thickness of the resist layer 300 is limited to about 50 μm.

For this reason, in the process of FIG. 2B, it is necessary to further form the second copper-plated layer. In this case, in order to prevent the electric short of the adjacent conductor pattern layers 200, it is necessary to introduce a special process such as an anisotropic copper plating, which increases the manufacturing cost.

Also, as measures against the above problem, a method of further patterning a separate resist layer to stack and form walls on the resist layer 300 in the process of FIG. 1C before forming the second copper-plated layer 260 may be considered.

However, when the pitch of the base copper layer pattern 220 is narrowed, it is difficult to position, stack and pattern the resist layer on a concave-convex surface with precision.

An inductor device and a method of manufacturing the same of an exemplary embodiment to be described later can solve the above problems.

Exemplary Embodiment

Figure 11A:
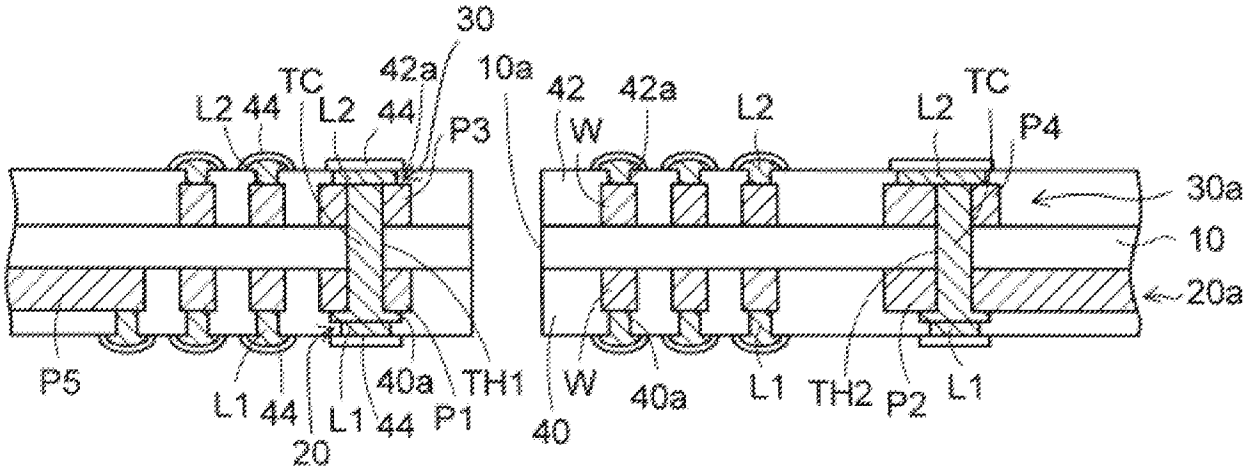
FIGS. 11A and 11B are sectional views depicting the method of manufacturing the inductor device in accordance with the exemplary embodiment (9 thereof).
Figure 11B:
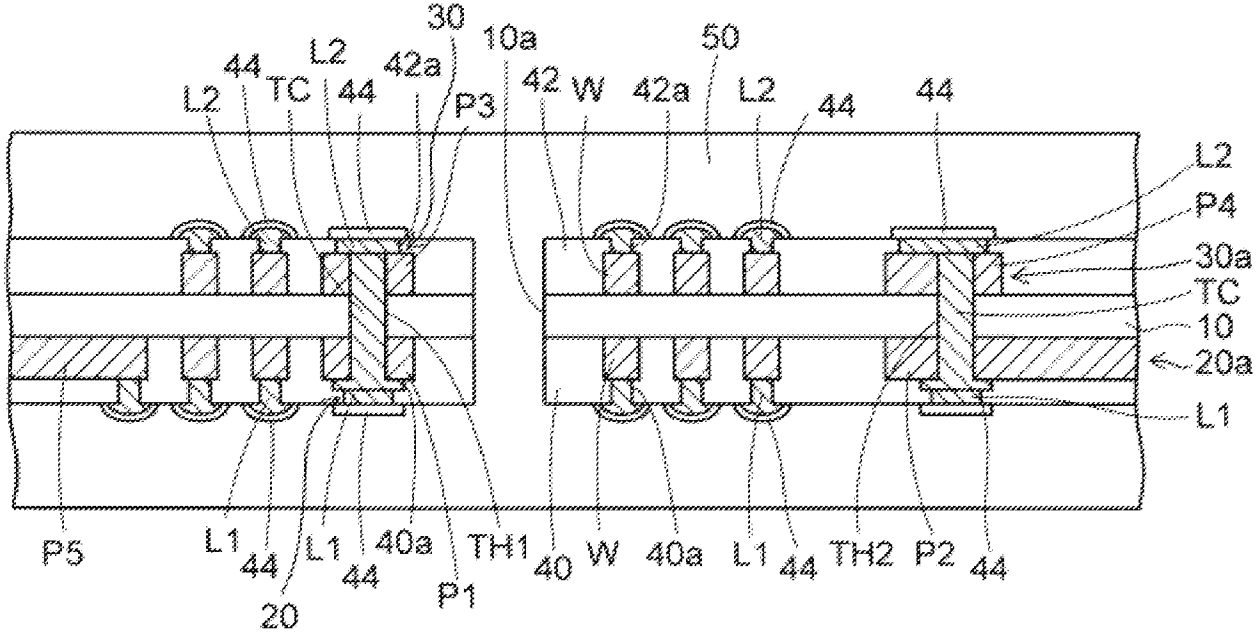
Figure 12:
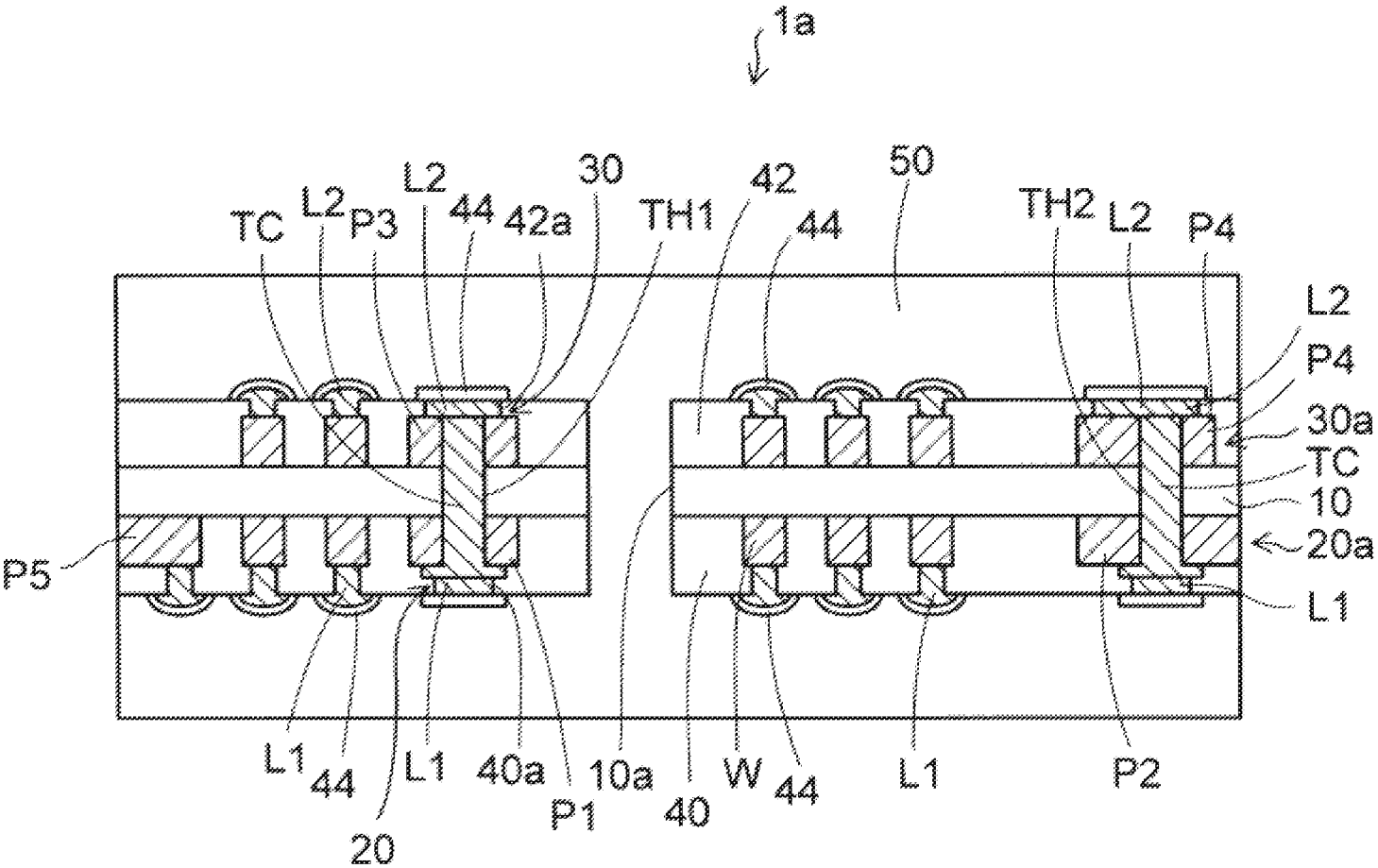
FIG. 12 is a sectional view depicting the method of manufacturing the inductor device in accordance with the exemplary embodiment (10 thereof).
Figure 13:
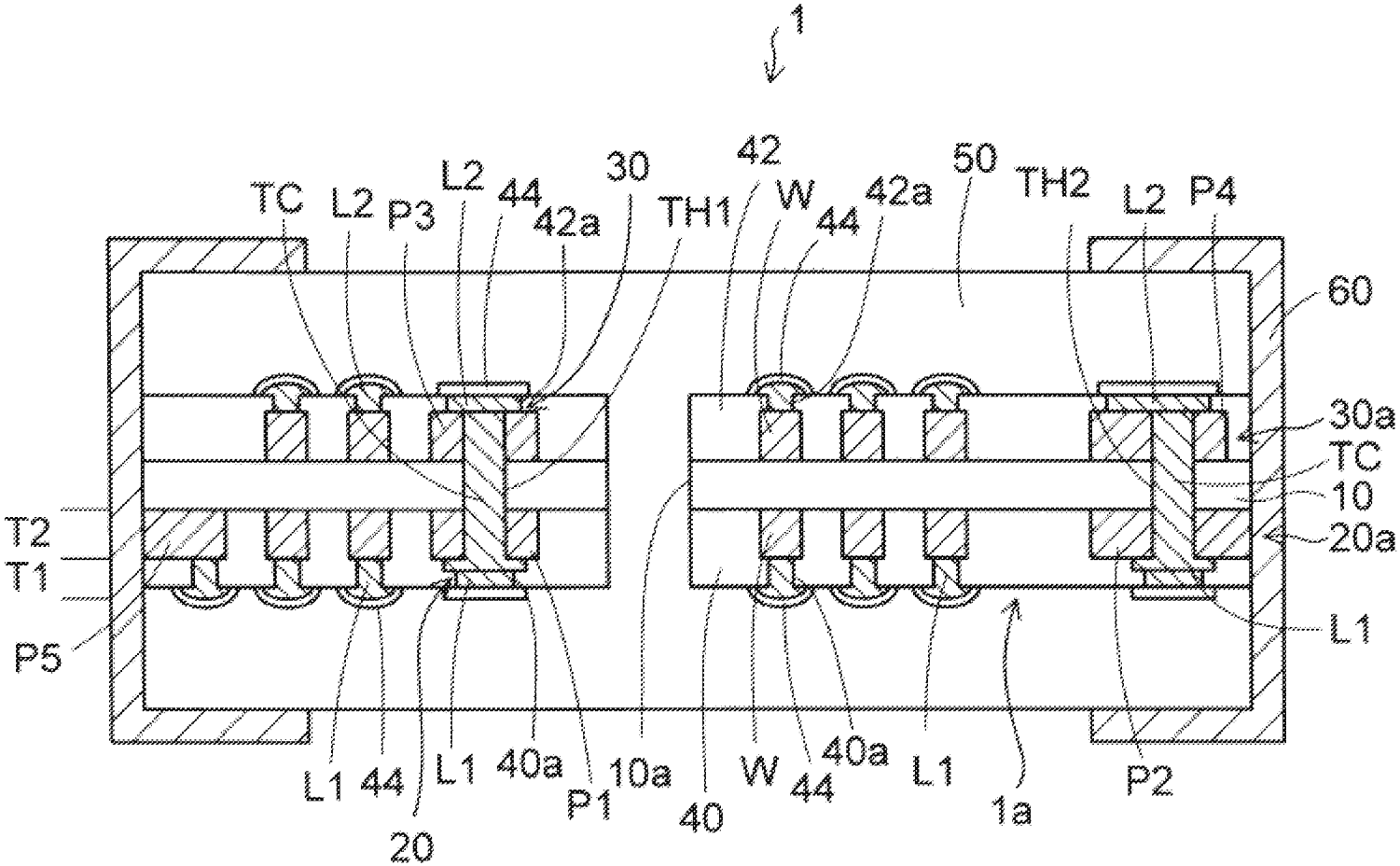
FIG. 13 is a sectional view depicting an inductor device in accordance with the exemplary embodiment.
Figure 14:
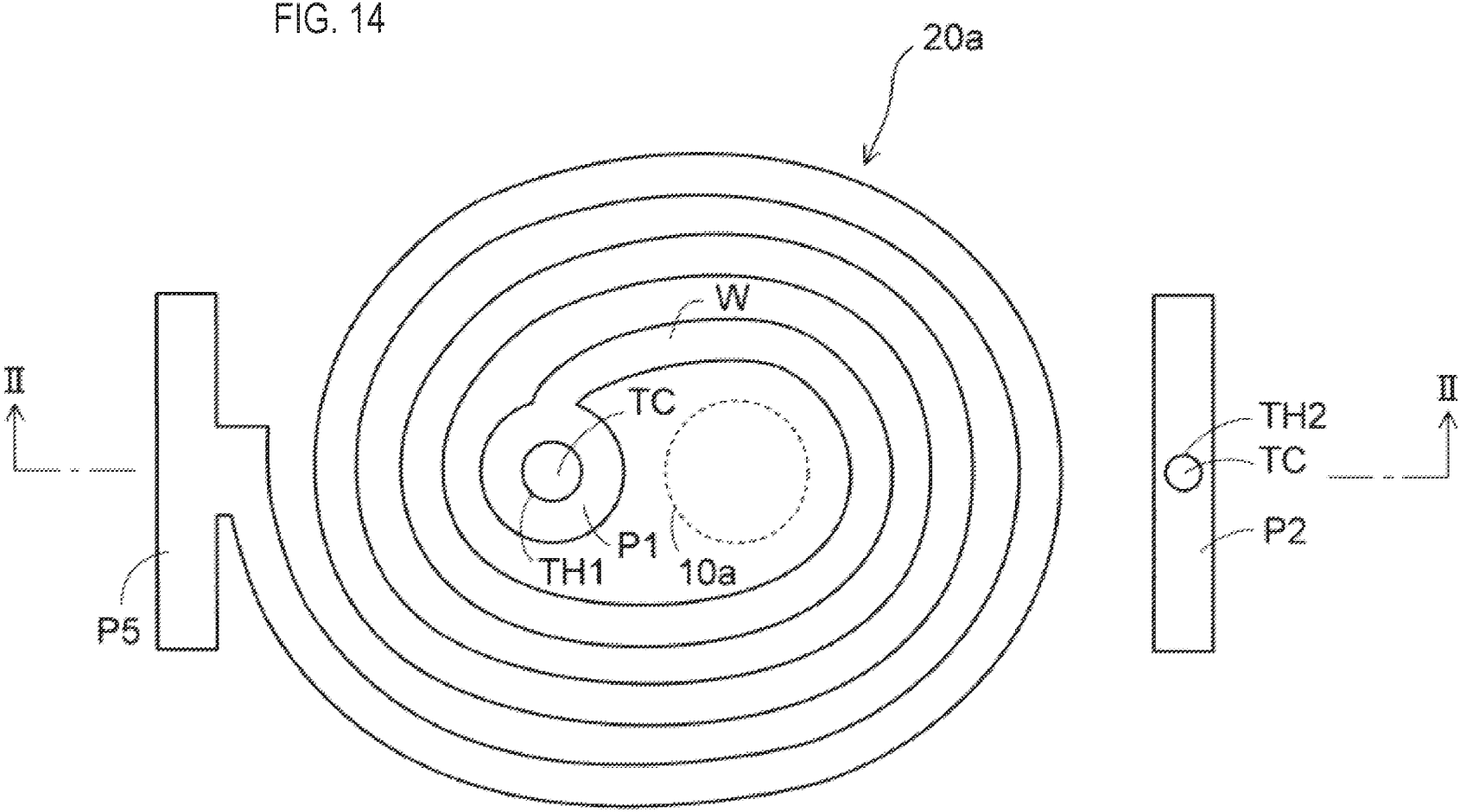
FIG. 14 is a plan view depicting a first base conductor layer provided at a lower surface-side of the inductor device shown in FIG. 13.
Figure 15:
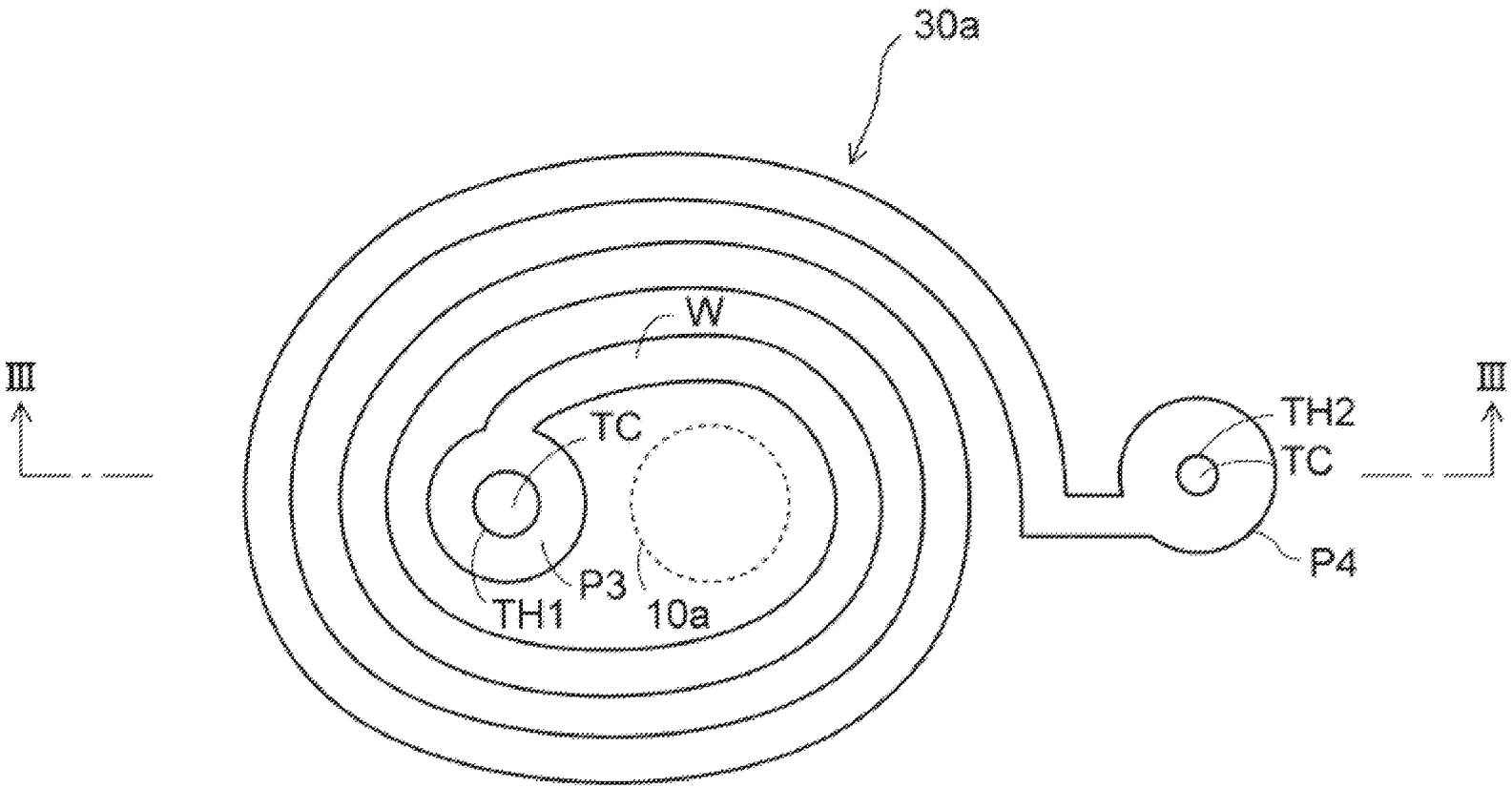
FIG. 15 is a plan view depicting a second base conductor layer provided at an upper surface-side of the inductor device shown in FIG. 13.

FIGS. 3A to 12 illustrate a method of manufacturing an inductor device in accordance with an exemplary embodiment, and FIGS. 13 to 15 illustrate an inductor device of the exemplary embodiment.

Hereinafter, a structure of an inductor device is described while describing a method of manufacturing the inductor device.

Figure 3A:
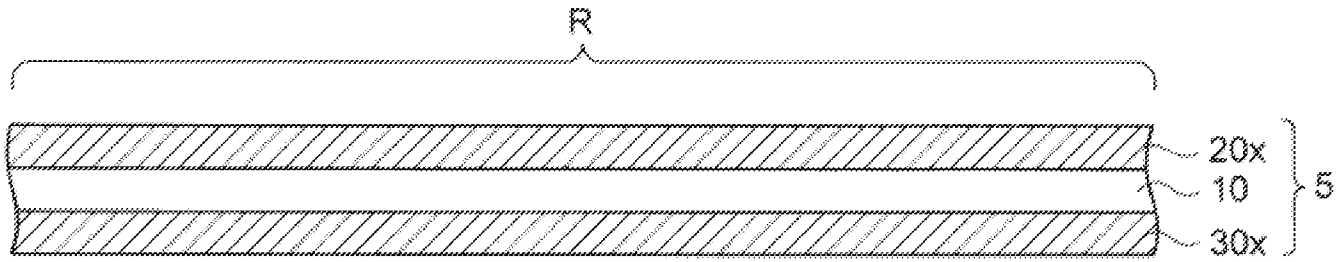
FIGS. 3A and 3B are sectional views depicting a method of manufacturing an inductor device in accordance with an exemplary embodiment (1 thereof).

In the method of manufacturing the inductor device of the exemplary embodiment, as shown in FIG. 3A, a stacked base material 5 is first prepared. The stacked base material 5 includes a resin film 10, a first copper foil 20*x* adhered to an upper surface of the resin film 10, and a second copper foil 30*x* adhered to a lower surface of the resin film 10. As the resin film 10, a polyimide film, a polyester film or an epoxy film is favorably used.

In the exemplary embodiment, one surface of the resin film 10 is defined as the upper surface, and the other surface of the resin film 10 is defined as the lower surface. Alternatively, one surface of the resin film 10 may be defined as the lower surface, and the other surface of the resin film 10 may be defined as the upper surface.

The first copper foil 20*x* is an example of the first metal foil, the second copper foil 30*x* is an example of the second metal foil, and a variety of metal foils functioning as coil layers of the inductor device may be used.

For example, a thickness of the resin film 10 is 15 μm to 50 nm, and each thickness of the first copper foil 20*x* and the second copper foil 30*x* is 35 μm to 70 μm. The stacked base material 5 is also referred to as flexible copper clad laminate (FCCL).

Figure 3B:
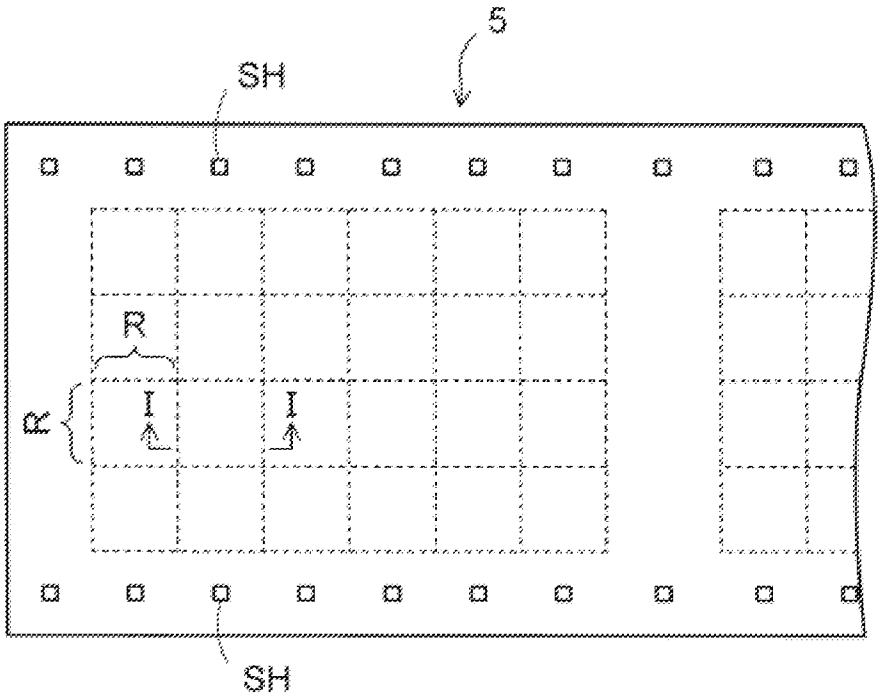

FIG. 3B is a reduced plan view depicting an entire shape of the stacked base material 5 of FIG. 3A. As shown in the plan view of FIG. 3B, the stacked base material 5 is a rectangular flexible base material. For example, a material wound on a roll is long withdrawn and conveyed.

The stacked base material 5 is formed with a plurality of product regions R and is cut for each product region R. In the sectional view of FIG. 3A, one product region R in the plan view of FIG. 3B is partially shown. The sectional view of FIG. 3A is a view taken along a line I-I of FIG. 3B.

The stacked base material 5 is formed with sprocket holes SH at both end portions in a width direction by press working or the like. The sprocket holes SH are arranged side by side with predetermined intervals in a longitudinal direction of the stacked base material 5. During the manufacturing process of the inductor device, when conveying the stacked base material 5 to a variety of manufacturing apparatuses, pins are inserted into the sprocket holes SH and the stacked base material is thus positioned.

Figure 4A:
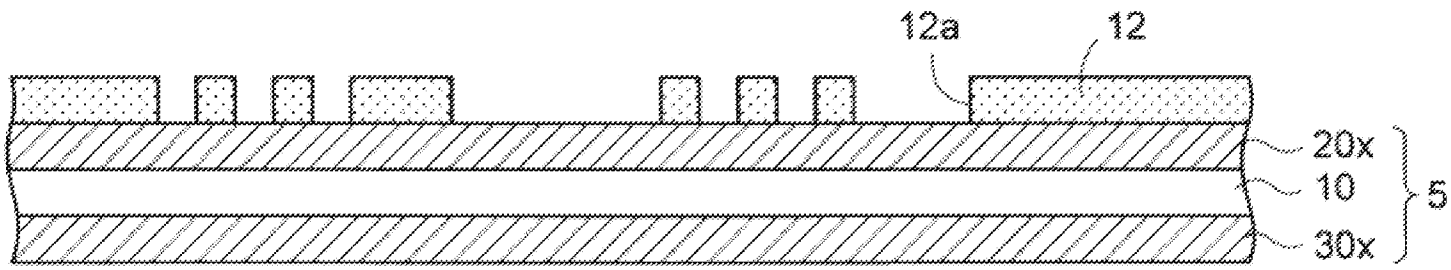
FIGS. 4A to 4C are sectional views depicting the method of manufacturing the inductor device in accordance with the exemplary embodiment (2 thereof).

Then, as shown in FIG. 4A, a resist layer 12 having openings 12*a* formed therein is patterned on the upper surface of the stacked base material 5 by a photolithography method.

Figure 4B:
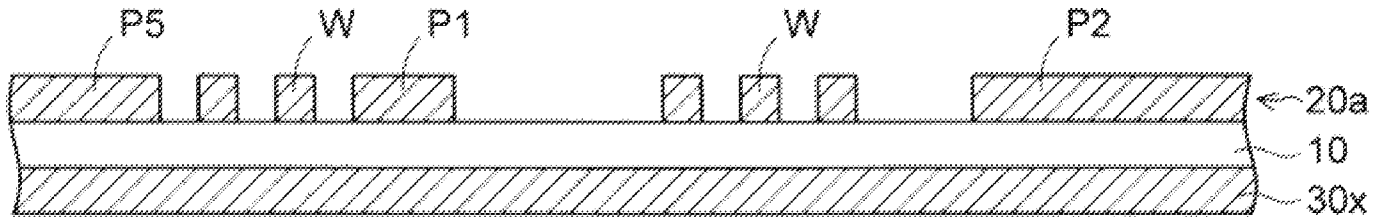

Also, as shown in FIG. 4B, the first copper foil 20*x* is wet-etched through the openings 12*a* by using the resist layer 12 as a mask, so that a first base conductor layer 20*a* is obtained. In this etching process, the etching is performed in a state that the second copper foil 30*x* side is covered by a mask plate (not shown). Then, the resist layer 12 is removed.

The first base conductor layer 20*a* is formed by a first pad P1 arranged at a center-side of the product region R, a second pad P2 arranged at one end-side of the product region R, a fifth pad P5 arranged at the other end-side of the product region R, and a wiring part W configured to connect the first pad P1 and the fifth pad P5 each other.

The first base conductor layer 20*a* extends with being coupled from the first pad P1, which is a starting point, to the fifth pad P5 via the wiring part W arranged in a spiral shape. The second pad P2 is arranged with being separated from the other part of the base conductor layer 20*a*.

In the meantime, the sprocket holes SH of FIG. 3B may be formed after forming the first base conductor layer 20*a*.

In this way, the first copper foil 20*x* of a thick film is patterned by a subtractive process to form the first base conductor layer 20*a*.

Figure 4C:
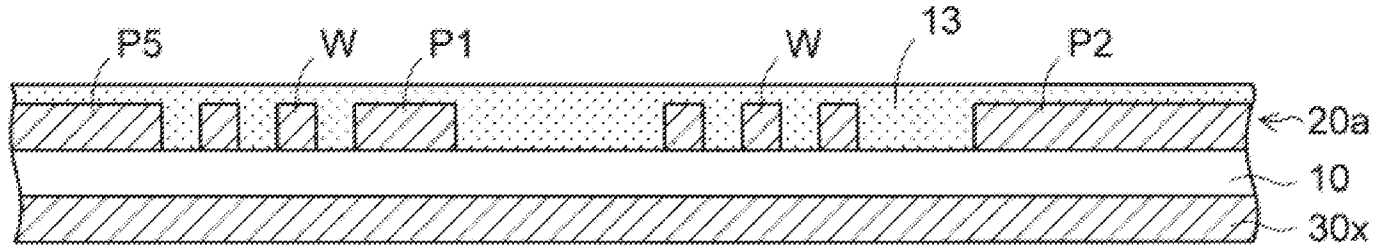
Figure 5A:
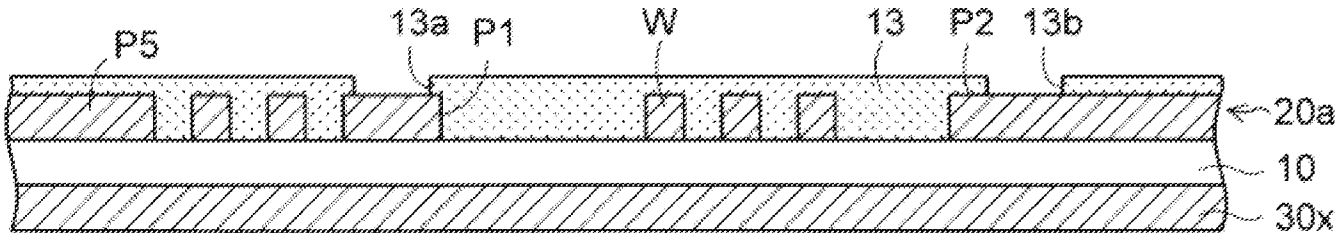
FIGS. 5A and 5B are sectional views and a plan view depicting the method of manufacturing the inductor device in accordance with the exemplary embodiment (3 thereof).

Subsequently, as shown in FIG. 4C, a plating resist layer 13 is formed at the upper surface-side of the stacked base material 5. Also, as shown in FIG. 5A, the plating resist layer 13 is patterned on the basis of the photolithography. Thereby, a hole-shaped first opening 13*a* of the plating resist layer 13 is arranged on the first pad P1 of the first base conductor layer 20*a*.

Also, at the same time, a hole-shaped second opening 13*b* of the plating resist layer 13 is arranged on the second pad P2 of the first base conductor layer 20*a*.

Figure 5B:
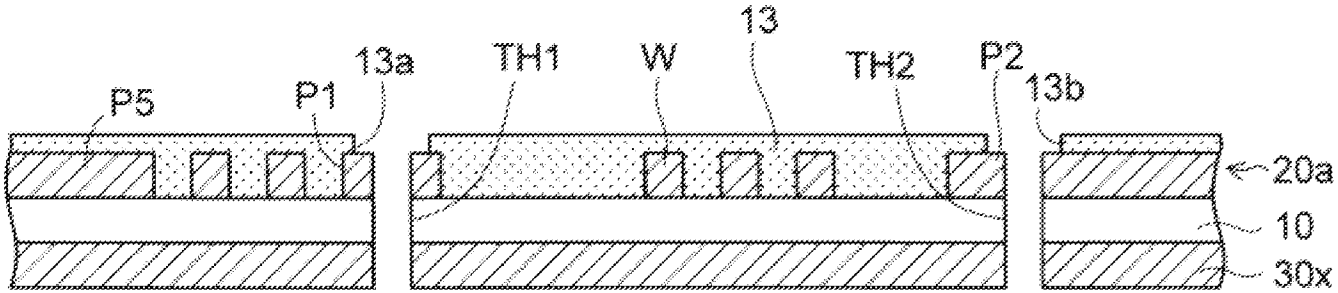
Figure 5B:
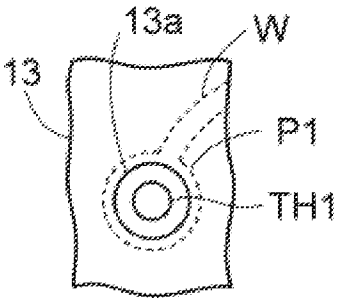

Then, as shown in FIG. 5B, a first through-hole TH1 penetrating the first pad P1 in the first opening 13*a* of the plating resist layer 13, the resin film 10 and the second copper foil 30*x* is formed by punching or the like.

Referring to a partial plan view of FIG. 5B, the first through-hole TH1 is arranged at a central portion of the first pad P1, and the first pad P1 is processed into a ring shape, as seen from a plan view. The first opening 13*a* of the plating resist layer 13 is arranged on a region of the first through-hole TH1 and the first pad P1 around there.

Also, a second through-hole TH2 penetrating from an upper surface of the second pad P2 in the second opening 13*b* of the plating resist layer 13 to a lower surface of the second copper foil 30*x* is formed. Like the first pad P1, the second through-hole TH2 is arranged in the second pad P2. The second opening 13*b* of the plating resist layer 13 is arranged on a region of the second through-hole TH2 and the second pad P2 around there.

Figure 6A:
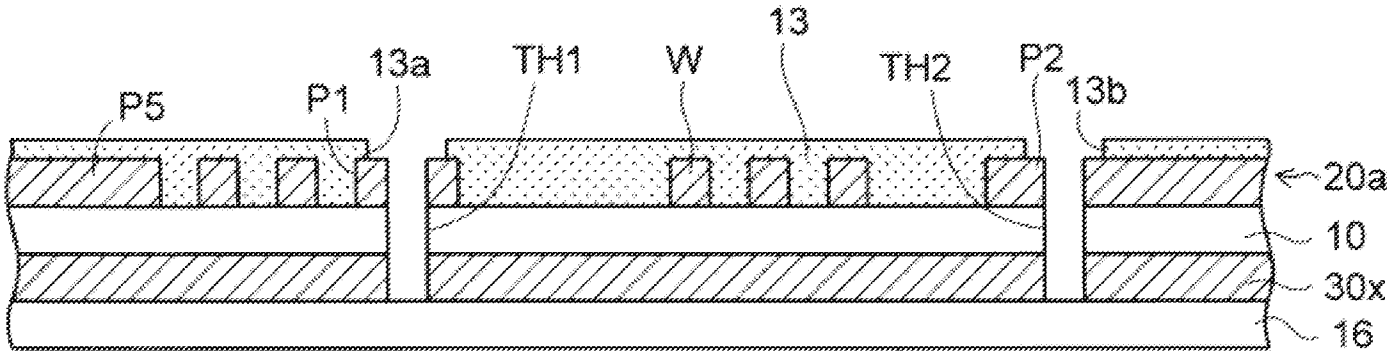
FIGS. 6A and 6B are sectional views depicting the method of manufacturing the inductor device in accordance with the exemplary embodiment (4 thereof).

Then, as shown in FIG. 6A, a masking tape 16 is adhered to a lower surface of the structure shown in FIG. 5B.

Figure 6B:
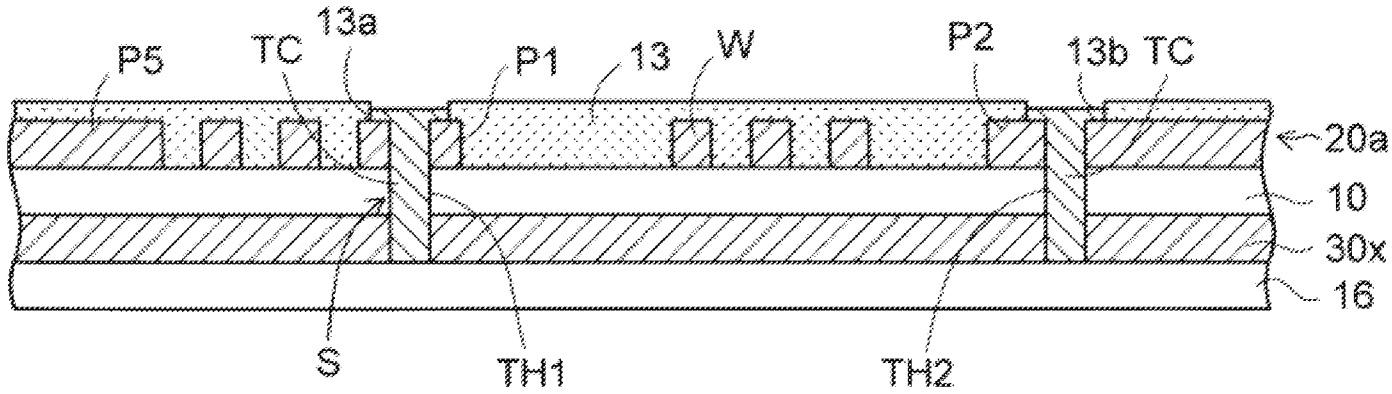

Also, as shown in FIG. 6B, a copper plated layer is filled in the first through-hole TH1 by an electrolytic plating, in which the second copper foil 30*x* is used as a plating power feeding path, so that a through conductor TC is formed. In the example of FIG. 6B, the through conductor TC is formed to cover an upper surface of the first pad P1. However, the through conductor TC may be formed so that an upper surface thereof is flush with the upper surface of the first pad P1.

The structure of FIG. 6B is adopted, so that a connection area between the through conductor TC and the first pad P1 increases. Therefore, it is possible to improve the mutual connection reliability.

In the exemplary embodiment, when forming the through conductor TC in the first through-hole TH1 by the electrolytic plating, a method in which an electroless plated layer made of copper functioning as a seed layer is not formed on a sidewall of the first through-hole TH1 is adopted.

For this reason, an electrolytic plated layer is directly formed on a side surface of the resin film 10 in the first through-hole TH1, so that the through conductor TC is obtained. Therefore, the through conductor TC and the resin film 10 exposed to a sidewall in the first through-hole TH1 are simply contacted (an interface denoted with S in FIG. 6B).

Thereby, when the resin film 10 is shrunk due to a heating treatment during a subsequent process, the resin film 10 is laterally separated from the through conductor TC in the first through-hole TH1, so that a crack is prevented from being formed in the through conductor TC.

Contrary to the exemplary embodiment, when an electroless plated layer is formed as a seed layer on the sidewall of the first through-hole TH1, since a copper plating grows from the entire sidewall of the first through-hole TH1, it is possible to favorably fill the through conductor TC in the first through-hole TH1.

However, according to this method, the resin film 10 exposed to the sidewall in the first through-hole TH1 and the through conductor TC are chemically bonded and are closely contacted. For this reason, when the resin film 10 is shrunk due to a heating treatment during a subsequent process, the through conductor TC in the first through-hole TH1 is laterally pulled by the resin film 10 and the stress is applied thereto, so that a crack can be easily formed in the through conductor TC.

However, the through conductor TC is formed to simply contact the resin film 10 on the sidewall in the first through-hole TH1, so that it is possible to improve the connection reliability of the through conductor TC.

Also, the through conductor TC is filled in the second through-hole TH2. Also, the through conductor TC is formed to simply contact the resin film 10 on the sidewall of the second through-hole TH2.

Figure 7A:
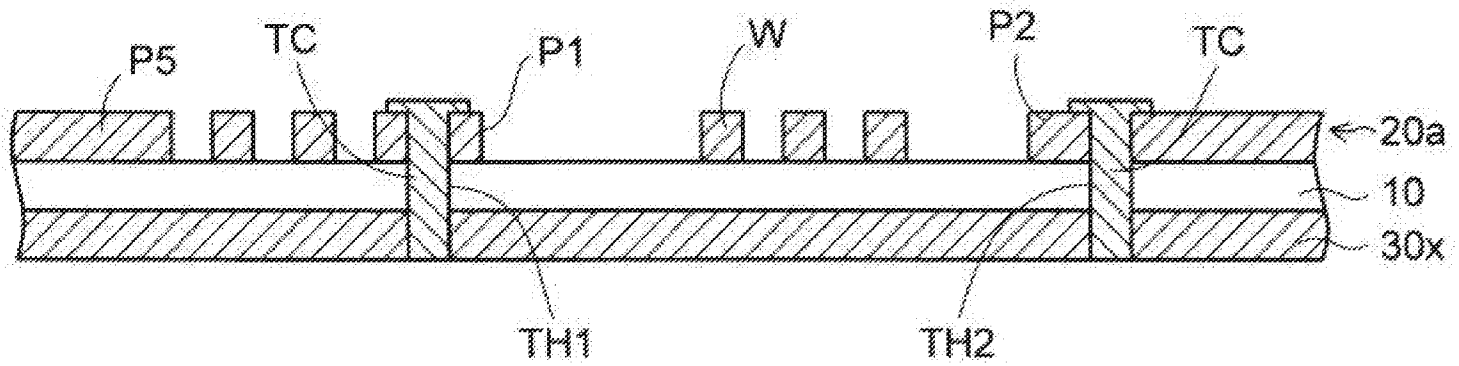
FIGS. 7A and 7B are sectional views depicting the method of manufacturing the inductor device in accordance with the exemplary embodiment (5 thereof).

Subsequently, as shown in FIG. 7A, the masking tape 16 and the plating resist layer 13 are removed from the structure of FIG. 6B.

Figure 7B:
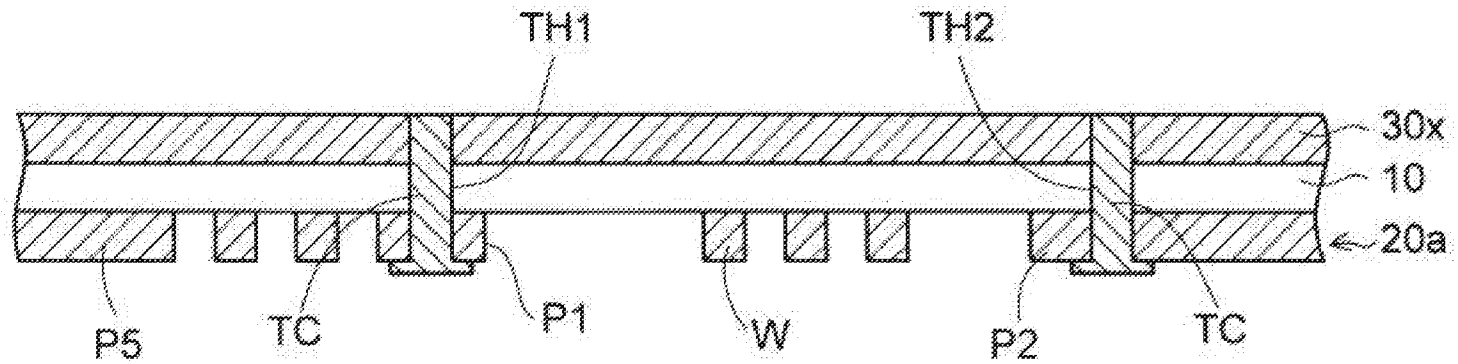

Also, as shown in FIG. 7B, the structure of FIG. 7A is inverted vertically, so that the second copper foil 30*x* is arranged at the upper side.

Figure 8A:
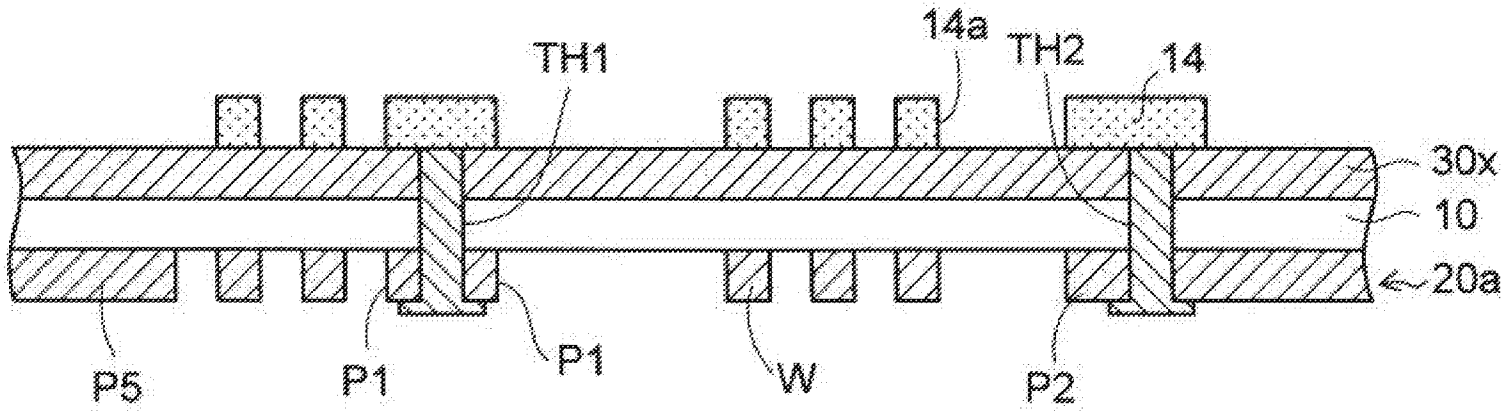
FIGS. 8A and 8B are sectional views depicting the method of manufacturing the inductor device in accordance with the exemplary embodiment (6 thereof).

Subsequently, as shown in FIG. 8A, a resist layer 14 having openings 14*a* formed therein is formed on the second copper foil 30*x* of the structure of FIG. 7B by the photolithography. The resist layer 14 is patterned so that a second base conductor layer is to be obtained from the second copper foil 30*x*.

Figure 8B:
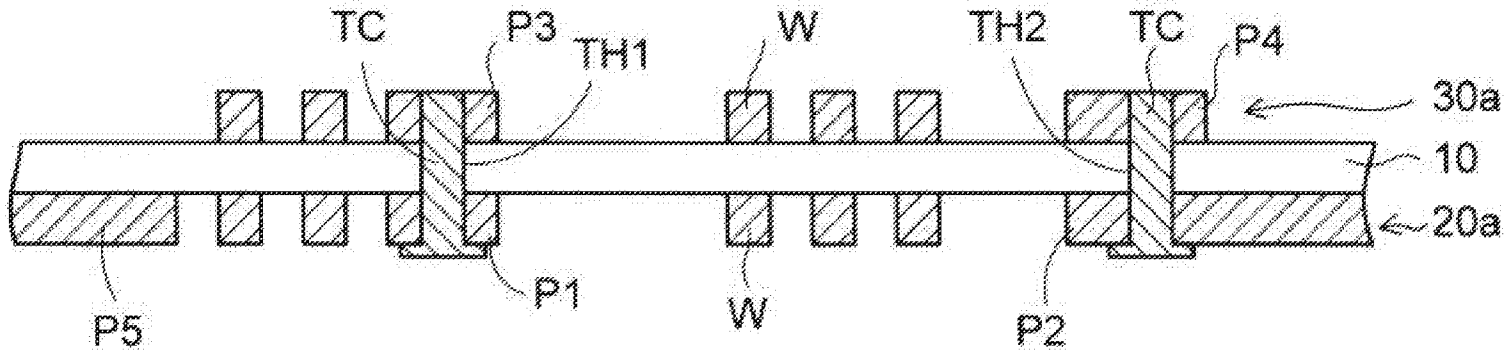

Subsequently, as shown in FIG. 8B, the second copper foil 30*x* is wet-etched through the openings 14*a* by using the resist layer 14 as a mask, so that a second base conductor layer 30*a* is obtained. In this etching process, the etching is performed in a state that the first base conductor layer 20*a* side is covered by a mask plate (not shown). Then, the resist layer 14 is removed.

The second base conductor layer 30*a* is formed to include a third pad P3 arranged at a position corresponding to the first pad P1 of the first base conductor layer 20*a*, a fourth pad P4 arranged at a position corresponding to the second pad P2, and a wiring part W configured to couple the third pad P3 and the fourth pad P4 each other.

Also, like the first base conductor layer 20*a*, the second base conductor layer 30*a* extends with being coupled from the third pad P3 arranged at a center-side, which is a starting point, to the fourth pad P4 arranged at one end-side via the wiring part W arranged in a spiral shape.

Also in the third pad P3 of the second base conductor layer 30*a*, the first through-hole TH1 is arranged at the central portion and is formed to have a ring shape, as seen from above, like the first pad P. The third pad P3 is connected to the through conductor TC filled in the first through-hole TH1.

In this way, the first pad P1 provided at the lower surface-side of the resin film 10 and the third pad P3 provided at the upper surface-side of the resin film 10 are coupled each other via the through conductor TC.

Also in the second base conductor layer 30*a*, the fourth pad P4 is formed therein with the second through-hole TH2 and is connected to the through conductor TC filled in the second through-hole TH2, like the third pad P3.

In this way, the second pad P2 provided at the lower surface-side of the resin film 10 and the fourth pad P4 provided at the upper surface-side of the resin film 10 are coupled each other via the through conductor TC.

Like this, the second copper foil 30*x* of the thick film is patterned by the subtractive process, so that the second base conductor layer 30*a* is formed.

Figure 9A:
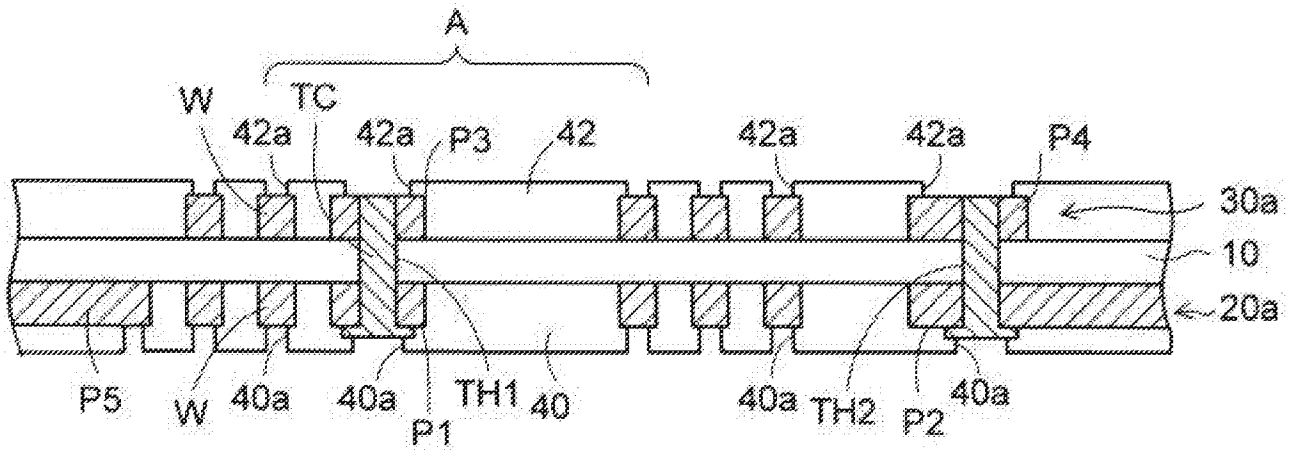
FIGS. 9A and 9B are a sectional view and a plan view depicting the method of manufacturing the inductor device in accordance with the exemplary embodiment (7 thereof).

Subsequently, as shown in FIG. 9A, photosensitive resin layers (not shown) are respectively formed on both surfaces of the structure of FIG. 8B. Also, the photosensitive resin layers on both surfaces are exposed, developed and patterned on the basis of the photolithography.

Thereby, a first insulating layer 40 having an opening 40*a* arranged on the first base conductor layer 20*a* is formed at the lower surface-side of the resin film 10. The opening 40*a* of the first insulating layer 40 is formed with being coupled along the first pad P1, the wiring part W and the fifth pad P5 of the first base conductor layer 20*a* in a spiral shape. Also, the opening 40*a* of the first insulating layer 40 is arranged on the second pad P2 arranged with being separated from the other part of the first base conductor layer 20*a*.

A width of the opening 40*a* of the first insulating layer 40 is set smaller than a width of the first base conductor layer 20*a*. Both sidewalls of the opening 40*a* of the first insulating layer 40 are arranged on both end portions of the first base conductor layer 20*a*.

Likewise, a second insulating layer 42 having an opening 42*a* arranged on the second base conductor layer 30*a* is formed at the upper surface-side of the resin film 10. The opening 42*a* of the second insulating layer 42 is formed with being coupled along the third pad P3, the wiring part W and the fourth pad P4 of the second base conductor layer 30*a* in a spiral shape. Like the first insulating layer 40, a width of the opening 42*a* of the second insulating layer 42 is set smaller than a width of the second base conductor layer 30*a*.

Figure 9B:
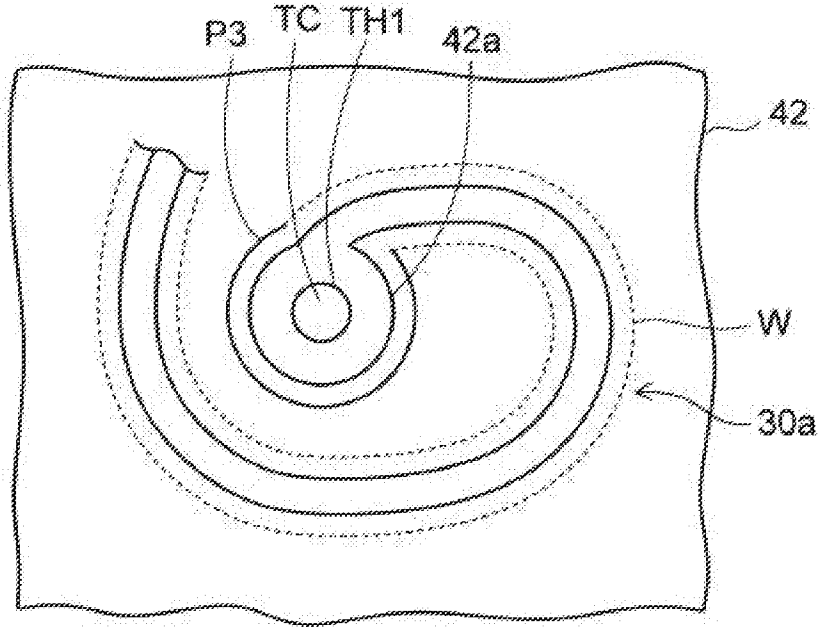

FIG. 9B is a partially enlarged plan view depicting a region A of the structure of FIG. 9A, as seen from above. As shown in the plan view of FIG. 9B, in the second base conductor layer 30*a*, the wiring part W arranged in a spiral shape is coupled to the third pad P3, and the wiring part W extends to the fourth pad P4 of the sectional view of FIG. 9A.

The opening 42*a* of the second insulating layer 42 is arranged with being coupled from the above of the third pad P3 to the above of the fourth pad P4 of the sectional view of FIG. 9A via the above of the wiring part W.

Also, the opening 40*a* of the first insulating layer 40 provided at the lower surface-side of the resin film 10 is arranged with being coupled from the above of the first pad P1 to the above of the fifth pad P5 of the sectional view of FIG. 9A via the above of the wiring part W.

For the first insulating layer 40 and the second insulating layer 42, a photosensitive permanent resist layer, a photosensitive polyimide resin, an epoxy resin or the like is favorably used, for example.

A height of the first opening 42*a* of the second insulating layer 42 on the third pad P3 and the wiring part W of the second base conductor layer 30*a* is about 40 μm to 50 μm, for example. This also applies to a height of the second opening 40*a* of the first insulating layer 40 on the first base conductor layer 20*a*.

Figure 10A:
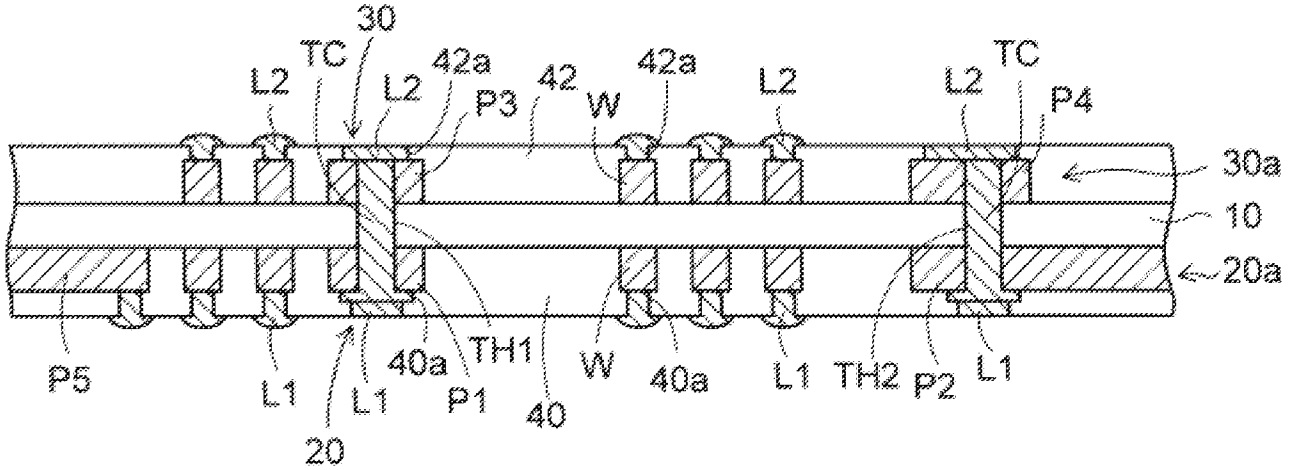
FIGS. 10A and 10B are sectional views depicting the method of manufacturing the inductor device in accordance with the exemplary embodiment (8 thereof).

Subsequently, as shown in FIG. 10A, a first conductor part L is formed on (below in FIG. 10A) the first base conductor layer 20*a* in the opening 40*a* of the first insulating layer 40 by an electrolytic plating in which the first base conductor layer 20*a* provided at the lower surface-side of the resin film 10 is used as a plating power feeding path. The first conductor part L1 is formed by a copper plated layer, for example.

As shown in the plan view of FIG. 9B, an area of the third pad P3 of the second base conductor layer 30*a* is greater than an area of the wiring part W. Likewise, each area of the first pad P1 and the second pad P2 of the first base conductor layer 20*a* provided at the lower surface-side of the resin film 10 is greater than the area of the wiring part W.

For this reason, in the first pad P1 and the second pad P2, a current density of the electrolytic plating per unit area is smaller than the wiring part W.

As a result, a thickness of the first conductor part L1 to be formed on the first pad P1 and the second pad P2 is smaller than a thickness of the first conductor part L1 to be formed on the wiring part W.

For example, a thickness of each first conductor part L1 of the first pad P1 and the second pad P2 is 40 μm to 50 μm, and a thickness of the first conductor part L1 of the wiring part W is 50 μm to 100 μm.

In this way, the first conductor part L1 is formed on the first base conductor layer 20*a*, so that a first conductor pattern layer 20 is obtained. A thickness of the first conductor pattern layer 20 can be increased by a thickness of the first conductor part L1, as compared to a configuration where the first conductor pattern layer 20 is formed only by the first base conductor layer 20*a*. Since the first conductor pattern layer 20 is formed as the first conductor part L1 is stacked on the first base conductor layer 20*a*, it is possible to increase a cross-sectional area of the first conductor pattern layer 20, as compared to a configuration where the first conductor pattern layer 20 is formed only by the first base conductor layer 20*a*.

The first conductor pattern layer 20 formed by the first base conductor layer 20*a* and the first conductor part L1 has a convex sectional shape. In other words, in a cross-sectional shape, a width of the first base conductor layer 20*a* is larger than a width of the first conductor part L1.

Since a plating rate is low in the first pad P1 and the second pad P2 of the first conductor pattern layer 20, a tip end face of the first conductor part L1 is arranged at a position in the opening 40*a* of the first insulating layer 40.

For this reason, the first conductor part L1 arranged on the first pad P1 has a quadrangular sectional shape. Also, a width of the first conductor part L1 is set smaller than a width of the first pad P1.

On the other hand, since the plating rate is high in the wiring part W of the first conductor pattern layer 20, the first conductor part L1 is formed from an inside of the opening 40*a* of the first insulating layer 40 with covering an upper surface (a lower surface, in FIG. 10B) around the opening.

For this reason, the first conductor part L1 arranged on the wiring part W has a mushroom sectional shape. The first conductor part L1 on the wiring part W protrudes from an upper surface of the first insulating layer 40 by about 10 μm to 30 μm.

In this way, the first conductor part L1 arranged on the wiring part W of the first base conductor layer 20*a* fills the opening 40*a* of the first insulating layer 40, and protrudes from the upper surface of the first insulating layer 40 in a semi-circular sectional shape.

Like this, the opening 40*a* of the first insulating layer 40 is arranged on the first base conductor layer 20*a*, and the first insulating layer 40 is arranged as a wall between the adjacent first base conductor layers 20*a*. At this state, the first conductor part L1 is formed in the opening 40*a* of the first insulating layer 40 by the electrolytic plating, so that a cross-sectional area of the first base conductor layer 20*a* is increased.

For this reason, when increasing the cross-sectional area of the first base conductor layer 20*a* to obtain the first conductor pattern layer 20, there are no concerns that the first conductor pattern layers 20 will contact, so that an electric short is prevented.

Also, since the width of the opening 40*a* of the first insulating layer 40 is set smaller than the width of the first base conductor layer 20*a*, it is possible to increase the cross-sectional area of the first base conductor layer 20*a* without increasing an arrangement pitch of the first base conductor layer 20*a*.

Also, the first base conductor layer 20*a* is formed from the first copper foil 20*x* of a thick film. For this reason, it is possible to obtain the first conductor pattern layer 20 having a desired thickness by patterning the first insulating layer 40 on the first base conductor layer 20*a* one time and forming the first conductor part L1 in the opening 40*a*.

For example, when the thickness of the first base conductor layer 20*a* (the first copper foil 20*x*) is 35 μm to 70 μm and the height of the opening 40*a* of the first insulating layer 40 is 40 μm to 50 μm, it is possible to easily form the first conductor pattern layer 20 having a thickness of 75 μm to 120 μm or greater.

The height of the opening 40*a* of the first insulating layer 40 is adjusted in correspondence to the thickness of the first conductor part L1 to be formed in the opening 40*a*.

When the conductor pattern layer of a thick film is formed by the formation method of the conductor pattern layer described in the preliminary matters, the adjacent conductor pattern layers are contacted, so that an electric short is caused.

Also, at the same time, a second conductor part L2 is formed on the second base conductor layer 30*a* in the opening 42*a* of the second insulating layer 42 by an electrolytic plating in which the second base conductor layer 30*a* provided at the upper surface-side of the resin film 10 is used as a plating power feeding path.

In this way, the second conductor part L2 is formed on the second base conductor layer 30*a*, so that a second conductor pattern layer 30 is obtained. Since the second conductor pattern layer 30 is formed as the second conductor part L2 is stacked on the second base conductor layer 30*a*, it is possible to increase a cross-sectional area, as compared to a configuration in which the second conductor pattern layer is formed only by the second base conductor layer 30*a*.

A height of the opening 42*a* of the second insulating layer 42 is adjusted in correspondence to a thickness of the second conductor part L2 to be formed in the opening 42*a*.

The second conductor pattern layer 30 formed by the second base conductor layer 30*a* and the second conductor part L2 has a convex sectional shape, like the first conductor pattern layer 20.

Also, like the first conductor part L1, a thickness of the second conductor part L2 to be formed on the third pad P3 and the fourth pad P4 of the second base conductor layer 30*a* is formed to be smaller than a thickness of the second conductor part L2 to be formed on the wiring part W.

In this way, like the first conductor part L1 of the first conductor pattern layer 20, the second conductor part L2 having a quadrangular sectional shape is formed on the third pad P3 and the fourth pad P4 of the second base conductor layer 30*a*. Also, likewise, the second conductor part L2 having a mushroom sectional shape is formed on the wiring part W of the second base conductor layer 30*a*.

In this way, the second conductor part L2 arranged on the wiring part W of the second base conductor layer 30*a* fills the opening 42*a* of the second insulating layer 42, and protrudes from the upper surface of the second insulating layer 42 in a semi-circular shape.

By the above, it is possible to increase the cross-sectional area of the first conductor pattern layer 20, as compared to a configuration where the first conductor pattern layer 20 is formed only by the first base conductor layer 20*a*. Likewise, it is possible to increase the cross-sectional area of the second conductor pattern layer 30, as compared to a configuration where the second conductor pattern layer 30 is formed only by the second base conductor layer 30*a*.

Thereby, the direct current resistances of the first conductor pattern layer 20 and the second conductor pattern layer 30 are reduced, so that it is possible to reduce the power consumption of the inductor device.

When a conductor layer is formed by the electrolytic plating, uniformity of the thickness in a plane of the resin film 10 is deteriorated. Therefore, the thicker the film is, the greater an absolute value of the non-uniformity of the thickness in a plane is.

In contrast, the thicknesses of the first copper foil 20*x* and the second copper foil 30*x* for forming the first base conductor layer 20*a* and the second base conductor layer 30*a* are favorable in terms of the uniformity. For this reason, in the first conductor pattern layer 20, the thickness of the first conductor part L1 is set smaller than the thickness of the first base conductor layer 20*a* (the first copper foil 20*x*).

Also in the second conductor pattern layer 30, the thickness of the second conductor part L2 is set smaller than the thickness of the second base conductor layer 30*a* (the second copper foil 30*x*).

In this way, when increasing the cross-sectional area by forming the first conductor part L1 on the first base conductor layer 20*a*, the uniformity in the thickness of the first conductor pattern layer 20 is prevented from being deteriorated, and the uniformity in the thickness of the design specification can be secured.

For example, when the thicknesses of the first base conductor layer 20*a* and the second base conductor layer 30*a* (the first copper foil 20*x* and the second copper foil 30*x*) are 35 μm to 70 μm, the thicknesses of the first conductor part L1 and the second conductor part L2 on the wiring part W are set to 20 μm to 60 μm.

In this example, the heights of the openings 40*a*, 42*a* of the first and second insulating layers 40, 42 are set to 10 μm to 50 μm.

Alternatively, when the uniformity in the thickness of the first conductor pattern layer 20 and the second conductor pattern layer 30 is not problematic, the first and second conductor parts L1, L2 may be formed to be thicker, for example about 50 to 100 μm.

Figure 10B:
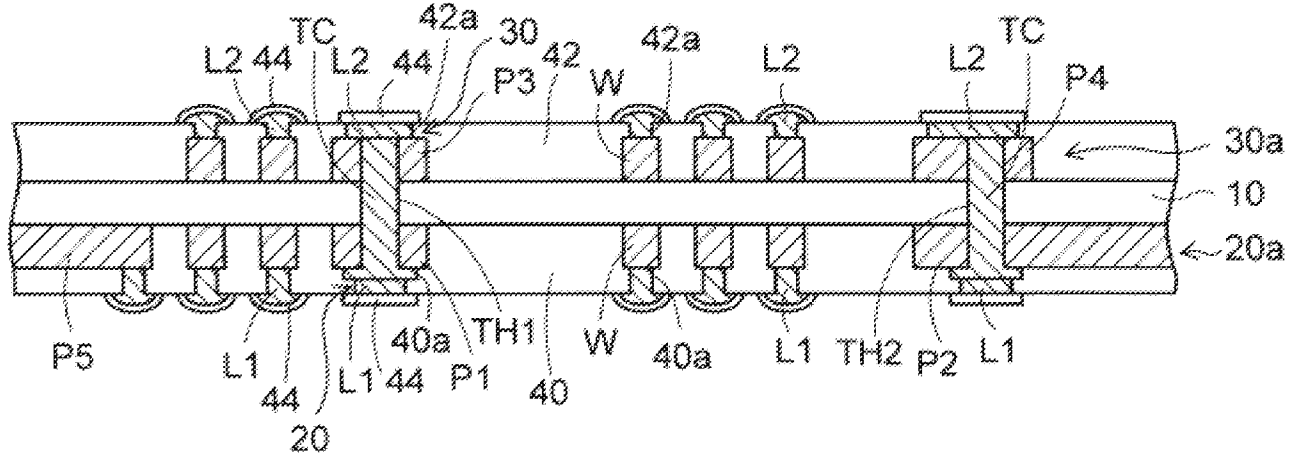

Subsequently, as shown in FIG. 10B, an epoxy resin, a polyimide resin or the like is selectively attached to the respective exposed surfaces of the first conductor part L1 provided at the lower surface-side of the resin film 10 and the second conductor part L2 provided at the upper surface-side by an electrodeposition coating, so that a protective insulating layer 44 is formed.

Alternatively, the protective insulating layer 44 may be formed by patterning a solder resist layer on the respective exposed surfaces of the first conductor part L1 and the second conductor part L2 formed at both surfaces-side of the resin film 10 through a screen printing.

Subsequently, as shown in FIG. 11A, a central part of the structure of FIG. 10B arranged in each product region R shown in FIG. 3B is punched out by press working, so that a through-hole 10*a* is formed. Also, an outer peripheral part of the structure of FIG. 10B arranged in each product region R is punched out to have a predetermined outer shape. At this point of time, the structures of FIG. 11A arranged in the respective product regions R are coupled to each other.

Then, as shown in FIG. 11B, a powder metal-based magnetic material is shaped with high pressures, so that both surfaces of the structure of FIG. 11A are covered with a magnetic body 50 and the through-hole 10*a* is filled with the magnetic body 50.

As the magnetic body 50, a magnetic body material such as powder ferrite and the like is used. The magnetic body material is shaped with high pressures while using an insulating resin such as epoxy resin, polyimide resin or the like as a binder, so that the magnetic body 50 is formed. Alternatively, the magnetic body 50 may be formed by sandwiching both surfaces of the structure of FIG. 11A with resin films containing magnetic body materials and laminating them.

Subsequently, as shown in FIG. 12, the structure of FIG. 11B is cut to obtain an inductor member 1*a* from each product region R of FIG. 3B.

At this time, side surfaces of the first conductor pattern layer 20 provided at the lower surface-side of the resin film 10 are exposed to a pair of facing outer walls of each inductor member 1*a*. That is, a side surface of the second pad P2 of the first conductor pattern layer 20 is exposed to an outer wall of one end-side of the inductor member 1*a*, and a side surface of the fifth pad P5 of the first conductor pattern layer 20 is exposed to an outer wall of the other end-side.

Thereafter, as shown in FIG. 13, the pair of facing outer walls of the inductor member 1*a* is formed with external connection electrodes 60, respectively. Thereby, the external connection electrodes 60 are respectively connected to the side surfaces of the second pad P2 and the fifth pad P5 of the first conductor pattern layer 20 exposed from the magnetic body 50.

The external connection electrode 60 is formed to extend from an end portion of an upper surface of the inductor member 1*a* to an end portion of a lower surface via the outer wall. The external connection electrode 60 is formed by forming a copper layer or the like on the magnetic body 50, the resin film 10, the second pad P2 and the fifth pad P5 through a sputtering method or a plating method.

By the above processes, an inductor device 1 of the exemplary embodiment is obtained.

As shown in FIG. 13, the inductor device 1 of the exemplary embodiment has the resin film 10 at a central part in a thickness direction. The first base conductor layer 20*a* arranged in a spiral shape is formed on the lower surface of the resin film 10.

In the exemplary embodiment, one surface of the resin film 10 is defined as the upper surface, and the other surface of the resin film 10 is defined as the lower surface. Alternatively, one surface of the resin film 10 may be defined as the lower surface, and the other surface of the resin film 10 may be defined as the upper surface.

The first base conductor layer 20*a* is formed by the first pad P1 arranged at the center-side, the second pad P2 arranged at one end-side, the fifth pad P5 arranged at the other end-side, and the wiring part W configured to connect the first pad P1 and the fifth pad P5 each other.

FIG. 14 is a plan view depicting the first base conductor layer 20*a* provided at the lower surface-side of the inductor device 1 of FIG. 13, as seen from below. In FIG. 14, only the first base conductor layer 20*a* arranged in the spiral shape is shown.

As shown in FIG. 14, the first base conductor layer 20*a* extends with being coupled from the first pad P1 arranged at the center-side, which is a starting point, to the fifth pad P5 arranged at the other end-side via the wiring part W arranged in a spiral shape. The first base conductor layer 20*a* of FIG. 13 corresponds to a section taken along a line II-II of FIG. 14.

As seen from above, a variety of shapes such as circular, elliptical and rectangular shapes can be adopted as a winding shape of the first base conductor layer 20*a*.

Also, as shown in FIG. 13, like the first base conductor layer 20*a* of FIG. 14, the second base conductor layer 30*a* arranged in a spiral shape is formed on the upper surface of the resin film 10. FIG. 15 is a plan view depicting the second base conductor layer 30*a* provided at the upper surface-side of the inductor device 1 of FIG. 13, as seen from above. In FIG. 15, only the second base conductor layer 30*a* arranged in the spiral shape is shown.

Referring to FIGS. 13 and 15, the second base conductor layer 30*a* is formed by the third pad P3 arranged at the position corresponding to the first pad P1, the fourth pad P4 arranged at the position corresponding to the second pad P2, and the wiring part W configured to couple the third pad P3 and the fourth pad P4 each other.

As shown in FIG. 15, the second base conductor layer 30*a* extends with being coupled from the third pad P3 arranged at the center-side, which is a starting point, to the fourth pad P4 arranged at one end-side via the wiring part W arranged in a spiral shape. The second base conductor layer 30*a* of FIG. 13 corresponds to a section taken along a line III-III of FIG. 15.

As seen from above, a variety of shapes such as circular, elliptical and rectangular shapes can be adopted as a winding shape of the second base conductor layer 30*a*.

As shown in FIG. 13, the third pad P3, the resin film 10 and the first pad P1 are formed with the first through-hole TH1 penetrating in the thickness direction. The first through-hole TH1 penetrates from a central part of the upper surface of the third pad P3 to a central part of the lower surface of the first pad P1. Thereby, referring to FIGS. 14 and 15, the first pad P1 and the third pad P3 are formed to have a ring shape, as seen from above.

The first through-hole TH1 is filled with the through conductor TC, and the first pad P1 and the third pad P3 are coupled to each other via the through conductor TC. The first pad P1 and the third pad P3 are formed to include end portions of the through conductor TC arranged at a central part of the ring-shaped pad main body.

As described in the manufacturing method, the through conductor TC and the resin film 10 exposed to the sidewall in the first through-hole TH1 are simply contacted to each other.

Likewise, the fourth pad P4, the resin film 10 and the second pad P2 are formed with the second through-hole TH2 penetrating in the thickness direction. Referring to FIG. 14, the second pad P2 is formed to have an elongated rectangular shape, as seen from above, and the second through-hole TH2 is arranged at the central part thereof.

Also, the second through-hole TH2 is filled with the through conductor TC, and the second pad P2 and the fourth pad P4 are coupled to each other via the through conductor TC. The second pad P2 and the fourth pad P4 are formed to include end portions of the through conductor TC arranged at the central part of the pad main body.

Also, the through conductor TC and the resin film 10 exposed to the sidewall in the second through-hole TH2 are simply contacted to each other.

In this way, the fifth pad P5 provided at the lower surface-side of the resin film 10 is connected to the first pad P1 via the wiring part W. Also, the first pad P1 is connected to the third pad P3 provided at the upper surface-side of the resin film 10, via the through conductor TC.

Also, the third pad P3 is connected to the fourth pad P4 via the wiring part W. Also, the fourth pad P4 is connected to the second pad P2 provided at the lower surface-side of the resin film 10, via the through conductor TC. By this connection structure, the fifth pad P5 and the second pad P2 are electrically connected to each other.

Also, as shown in FIG. 13, the first insulating layer 40 having the opening 40*a* arranged on the first base conductor layer 20*a* is formed at the lower surface-side of the resin film 10. The width of the opening 40*a* of the first insulating layer 40 is set smaller than the width of the first base conductor layer 20*a*.

The opening 40*a* of the first insulating layer 40 is arranged with being coupled in a spiral shape along the first pad P1, the wiring part W and the fifth pad P5 of the first base conductor layer 20*a*. Also, the opening 40*a* of the first insulating layer 40 is arranged on the second pad P2 arranged with being separated from the other part of the first base conductor layer 20*a*.

The first conductor part L1 is formed on (below in FIG. 13) the first base conductor layer 20*a* in the opening 40*a* of the first insulating layer 40. The first conductor pattern layer 20 is formed by the first base conductor layer 20*a* and the first conductor part L1.

The width of the first conductor part L1 is set smaller than the width of the first base conductor layer 20*a*. Thereby, the first conductor pattern layer 20 has a convex sectional shape.

The first conductor part L1 arranged on the first and second pads P1, P2 has a quadrangular sectional shape.

Also, the first conductor part L1 arranged on the wiring part W is formed from the inside of the opening 40*a* of the first insulating layer 40 with covering the upper surface (the lower surface, in FIG. 13) of the first insulating layer 40 around the opening. Thereby, the first conductor part L1 arranged on the wiring part W has a mushroom sectional shape.

The sectional shapes of the first conductor part L1 on the first and second pads P1, P2 and the first conductor part L1 on the wiring part W are different. The reason is that the plating rates in the first and second pads P1, P2 are lower than the plating rate in the wiring part W, as described in the manufacturing method.

In this way, the first conductor pattern layer 20 is formed by the first base conductor layer 20*a* and the first conductor part L1 stacked thereon.

Herein, the thickness T1 of the first conductor part L1 arranged on the first base conductor layer 20*a* is set smaller than the thickness T2 of the first base conductor layer 20*a* (the first copper foil 20*x*). Thereby, as described in the manufacturing method, the uniformity in the thickness of the first conductor pattern layer 20, which is obtained as the first conductor part L1 is formed on the first base conductor layer 20*a*, is prevented from being deteriorated, and the uniformity in the thickness of the design specification can be secured.

Also, the second insulating layer 42 having the opening 42*a* arranged on the second base conductor layer 30*a* is formed at the upper surface-side of the resin film 10. The width of the opening 42*a* of the second insulating layer 42 is set smaller than the width of the second base conductor layer 30*a*.

Also, like the opening 40*a* of the first insulating layer 40, the opening 42*a* of the second insulating layer 42 is arranged with being coupled in a spiral shape along the third pad P3, the wiring part W and the fourth pad P4 of the second base conductor layer 30*a*.

The second conductor part L2 is formed on the second base conductor layer 30*a* in the opening 42*a* of the second insulating layer 42. The second conductor pattern layer 30 is formed by the second base conductor layer 30*a* and the second conductor part L2. The width of the second conductor part L2 is set smaller than the width of the second base conductor part 30*a*. Thereby, the second conductor pattern layer 30 has a convex sectional shape.

The second conductor part L2 arranged on the third and fourth pads P3, P4 has a quadrangular sectional shape.

Also, the second conductor part L2 on the wiring part W of the second base conductor layer 30*a* is formed from the inside of the opening 42*a* of the second insulating layer 42 with covering the upper surface of the second insulating layer 42 around the opening. Thereby, the second conductor part L2 on the wiring part W of the second base conductor layer 30*a* has a mushroom sectional shape.

The thickness of the second conductor part L2 arranged on the second base conductor layer 30*a* is set smaller than the thickness of the second base conductor layer 30*a* (the second copper foil 30*x*), like the first conductor part L1.

In this way, the first conductor pattern layer 20 is formed by stacking the first conductor part L1 on the first base conductor layer 20*a*. For this reason, as compared to a configuration where the first conductor pattern layer 20 is formed only by the first base conductor layer 20*a*, it is possible to increase the cross-sectional area of the first conductor pattern layer 20. Likewise, it is possible to increase the cross-sectional area of the second conductor pattern layer 30.

For this reason, the direct current resistances of the first conductor pattern layer 20 and the second conductor pattern layer 30 are reduced, so that it is possible to reduce the power consumption of the inductor device.

Also, the inductor device 1 is formed at its central part with the through-hole 10*a* penetrating the second insulating layer 42, the resin film 10 and the first insulating layer 40.

Also, the protective insulating layer 44 covering the first conductor part L1 of the first conductor pattern layer 20 and the second conductor part L2 of the second conductor pattern layer 30 is formed with being patterned.

Also, both surfaces of the inductor member 1*a* having the first conductor pattern layer 20 and the second conductor pattern layer 30 formed therein are covered with the magnetic body 50, and the through-hole 10*a* of the inductor member 1*a* is filled with the magnetic body 50.

Also, the external connection electrodes 60 are respectively formed on the pair of facing outer walls of the inductor member 1*a*. One external connection electrode 60 is connected to the side surface of the second pad P2 provided at one end-side of the first conductor pattern layer 20, and the other external connection electrode 60 is connected to the side surface of the fifth pad P5 provided at the other end-side of the first conductor pattern layer 20.

Thereby, the external connection electrodes 60 are connected to the first conductor pattern layer 20, and are electrically connected to the second conductor pattern layer 30 via the respective through conductors TC in the first through-hole TH1 and the second through-hole TH2.

Like this, in the inductor device 1 of the exemplary embodiment, the first base conductor layer 20*a* is formed from the first copper foil 20*x* of a thick film, and the opening 40*a* of the first insulating layer 40 is arranged thereon. Also, the first conductor part L1 is formed in the opening 40*a* of the first insulating layer 40 by the electrolytic plating, so that the first conductor pattern layer 20 having a large cross-sectional area is obtained.

Thereby, it is possible to obtain the first conductor pattern layer 20 having a desired cross-sectional area by patterning the first insulating layer 40 on the first base conductor layer 20*a* one time and forming the first conductor part L1 in the opening 40*a*.

Also, when forming the first conductor part L1 on the first base conductor layer 20*a*, the first insulating layer 40 is arranged as a wall between the adjacent first base conductor layers 20*a*. For this reason, the electric short, which is caused when the adjacent first base conductor layers 20*a* are contacted, is prevented, so that it is possible to manufacture the inductor device with high yields.

Also in the second base conductor layer 30*a*, the second conductor part L2 is stacked by the similar method, so that the second conductor pattern layer 30 having a large cross-sectional area is obtained.

Like this, in the inductor device 1 of the exemplary embodiment, since the first and second conductor pattern layers 20, 30 have the desired cross-sectional areas, the direct current resistances are reduced, so that it is possible to reduce the power consumption.

Also, the inductor device 1 of the exemplary embodiment is manufactured using the stacked base material 5 (flexible copper clad laminate (FCCL)) having a three-layered structure where the first copper foil 20*x* is adhered to one surface of the resin film 10 and the second copper foil 30*x* is adhered to the other surface.

Since the stacked base material 5 is generally used to manufacture a flexible wiring substrate and can be manufactured by the existing manufacturing apparatus of a manufacturing line of the flexible wiring substrate, a new facility investment is suppressed, so that it is possible to reduce the cost of the product.

This disclosure further encompasses various exemplary embodiments, for example, described below.

1. A method of manufacturing an inductor device, the method comprising:

preparing a stacked base material comprising a resin film, a first metal foil adhered to one surface of the resin film and a second metal foil adhered to the other surface of the resin film;

patterning the first metal foil of the stacked base material to form a first base conductor layer having a first pad;

forming a through-hole penetrating the stacked base material from the first pad to the second metal foil;

forming a through conductor in the through-hole to connect the first pad and the second metal foil via the through conductor;

pattering the second metal foil to form a second base conductor layer having a second pad to be connected to the through conductor;

forming, on one surface of the resin film, a first insulating layer having an opening arranged on the first base conductor layer; and forming a first conductor part on the first base conductor layer in the opening of the first insulating layer by an electrolytic plating and obtaining a first conductor pattern layer including the first base conductor layer and the first conductor part, wherein the first conductor pattern layer has a convex sectional shape.

2. The method according to claim 1, wherein the forming process of the first insulating layer comprises forming, on the other surface of the resin film, a second insulating layer having an opening arranged on the second base conductor layer, wherein the forming process of the first conductor part comprises forming a second conductor part on the second base conductor layer in the opening of the second insulating layer and obtaining a second conductor pattern layer including the second base conductor layer and the second conductor part, and wherein the second conductor pattern layer has a convex sectional shape.

3. The method according to claim 1 or 2, wherein the first base conductor layer has a wiring part to be coupled to the first pad, wherein the first conductor part arranged on the first pad has a quadrangular sectional shape, and wherein the first conductor part arranged on the wiring part has a mushroom sectional shape.

4. The method according to one of claims 1 to 3, wherein in the forming process of the through conductor, the through conductor is formed by an electrolytic plating, and the through conductor is formed to be in contact with the resin film on a sidewall of the through-hole.

5. The method according to one of claims 1 to 4, wherein a thickness of the first conductor part is smaller than a thickness of the first metal foil.

What is claimed is:

1. An inductor device comprising:

a resin film;

a first base conductor layer formed on one surface of the resin film and having a first pad;

a second base conductor layer formed on the other surface of the resin film and having a second pad at a position corresponding to the first pad;

a through-hole penetrating from the first pad to the second pad via the resin film in a sectional height direction of the inductor device;

a through conductor filled in the through-hole and provided to connect the first pad and the second pad each other;

a first insulating layer formed on the one surface of the resin film and having an opening arranged on the first base conductor layer; and a first conductor part formed on the first base conductor layer in the opening of the first insulating layer, wherein a first conductor pattern layer includes the first base conductor layer and the first conductor part, and a width of the first base conductor layer is greater than a width of the first conductor part, the width of the first base conductor layer and the width of the first conductor part being measured in a sectional width direction of the inductor device, the sectional width direction of the inductor device being perpendicular to the sectional height direction of the inductor device.

2. The inductor device according to claim 1, wherein the through conductor is formed of an electrolytic plated layer, and wherein the through conductor and the resin film on a sidewall of the through-hole are in contact with each other.

3. The inductor device according to claim 1, wherein the first base conductor layer is formed of a metal foil, and the first conductor part is formed of an electrolytic plated layer, and wherein a thickness of the first conductor part is smaller than a thickness of the first base conductor layer, the thickness of the first conductor part and the thickness of the first base conductor layer being measured in the sectional height direction of the inductor device.

4. The inductor device according to claim 1, further comprising:

a second insulating layer formed on the other surface of the resin film and having an opening arranged on the second base conductor layer; and a second conductor part formed on the second base conductor layer in the opening of the second insulating layer, wherein a second conductor pattern layer includes the second base conductor layer and the second conductor part, and a width of the second base conductor layer is greater than a width of the second conductor part, the width of the second base conductor layer and the width of the second conductor part being measured in the sectional width direction of the inductor device.

5. The inductor device according to claim 1, wherein the width of the first conductor part on the first pad is smaller than a width of the first pad, the width of the first pad being measured in the sectional width direction of the inductor device.

6. The inductor device according to claim 1, wherein the first conductor part is formed inside the opening of the first insulating layer, and the first conductor part extends from the opening and covers a portion of a first surface of the first insulating layer that surrounds the opening, said first surface of the first insulating layer being opposite to a second surface of the first insulating layer that faces the one surface of the resin film.

7. The inductor device according to claim 1, wherein the first base conductor includes a wiring part coupled to the first pad, and the first conductor part formed on the wiring part protrudes from a first surface of the first insulating layer, said first surface of the first insulating layer being opposite to a second surface of the first insulating layer that faces the one surface the resin film.

8. The inductor device according to claim 1, wherein the first conductor part formed on the first pad has a quadrangular sectional shape.

9. The inductor device according to claim 1, wherein the first base conductor includes a wiring part coupled to the first pad, and the first conductor part formed on the wiring part has a mushroom sectional shape.

10. The inductor device according to claim 1, wherein a width of the opening of the first insulating layer is smaller than the width of the first base conductor layer, the width of the opening of the first insulating layer being measured in the sectional width direction of the inductor device.

11. An inductor device comprising:

a resin film;

a first base conductor layer formed on one surface of the resin film and having a first pad and a wiring part coupled to the first pad;

a second base conductor layer formed on the other surface of the resin film and having a second pad at a position corresponding to the first pad;

a through-hole penetrating from the first pad to the second pad via the resin film in a sectional height direction of the inductor device;

a through conductor filled in the through-hole and provided to connect the first pad and the second pad each other;

a first insulating layer formed on the one surface of the resin film and having an opening arranged on the first base conductor layer; and a first conductor part formed on the first base conductor layer in the opening of the first insulating layer, wherein a first conductor pattern layer includes the first base conductor layer and the first conductor part, and the first conductor part formed on the wiring part protrudes from a first surface of the first insulating layer in the sectional height direction of the inductor device, said first surface of the first insulating layer being opposite to a second surface of the first insulating layer that faces the one surface of the resin film.

12. The inductor device according to claim 11, wherein the through conductor is formed of an electrolytic plated layer, and wherein the through conductor and the resin film on a sidewall of the through- hole are in contact with each other.

13. The inductor device according to claim 11, wherein the first base conductor layer is formed of a metal foil, and the first conductor part is formed of an electrolytic plated layer, and wherein a thickness of the first conductor part is smaller than a thickness of the first base conductor layer, the thickness of the first conductor part and the thickness of the first base conductor layer being measured in the sectional height direction of the inductor device.

14. The inductor device according to claim 11, further comprising:

a second insulating layer formed on the other surface of the resin film and having an opening arranged on the second base conductor layer; and a second conductor part formed on the second base conductor layer in the opening of the second insulating layer, wherein a second conductor pattern layer includes the second base conductor layer and the second conductor part, the second base conductor layer includes a second wiring part, and the second conductor part formed on the second wiring part protrudes from a second surface of the second insulating layer in the sectional height direction of the inductor device, said second surface of the second insulating layer being opposite to a first surface of the second insulating layer that faces the other surface of the resin film.

15. The inductor device according to claim 11, wherein a width of the first conductor part on the first pad is smaller than a width of the first pad, the width of the first conductor part and the width of the first pad being measured in a sectional width direction of the inductor device, the sectional width direction of the inductor device being perpendicular to the sectional height direction of the inductor device.

16. The inductor device according to claim 11, wherein the first conductor part is formed inside the opening of the first insulating layer, and the first conductor part extends from the opening and covers a portion of the first surface of the first insulating layer that surrounds the opening.

17. The inductor device according to claim 11, wherein the first conductor part formed on the first pad has a quadrangular sectional shape.

18. The inductor device according to claim 11, wherein the first conductor part formed on the wiring part has a mushroom sectional shape.

19. The inductor device according to claim 11, wherein a width of the opening of the first insulating layer is smaller than a width of the first base conductor layer, the width of the first base conductor layer and the width of the opening of the first insulating layer being measured in a sectional width direction of the inductor device, the sectional width direction of the inductor device being perpendicular to the sectional height direction of the inductor device.

* * * * *